US005315057A

United States Patent [19]

Land et al.

[11] Patent Number: 5,315,057

[45] Date of Patent: May 24, 1994

[54] METHOD AND APPARATUS FOR DYNAMICALLY COMPOSING MUSIC AND SOUND EFFECTS USING A COMPUTER ENTERTAINMENT SYSTEM

[75] Inventors: Michael Z. Land; Peter N. McConnell, both of Berkeley, Calif.

[73] Assignee: LucasArts Entertainment Company, Nicasio, Calif.

[21] Appl. No.: 800,461

[22] Filed: Nov. 25, 1991

[51] Int. Cl.[5] ..... G10H 1/00; G10H 7/00

[52] U.S. Cl. ..... 84/601; 84/609; 84/645

[58] Field of Search ..... 84/601, 602, 609-620, 84/622-638, 645, DIG. 2

[56] References Cited

U.S. PATENT DOCUMENTS

| | | | |
|---|---|---|---|
| 4,526,078 | 7/1985 | Chadabe | 84/602 |
| 4,960,031 | 10/1990 | Farrand | 84/609 |
| 4,974,486 | 12/1990 | Wallace | 84/609 |

*Primary Examiner*—Stanley J. Witkowski
*Attorney, Agent, or Firm*—Irell & Manella

[57] ABSTRACT

A computer entertainment system is disclosed for dynamically composing a music sound tract in response to dynamic and unpredictable actions and events initiated by a directing system in a way that is aesthetically appropriate and natural. The system includes a composition database having one or more musical sequences. One or more of the one or more musical sequences has one or more decision points. The decision points within the database comprise a composing decision tree, with the decision points marking places where branches in the performance of the musical sequences may occur. A sound driver interprets each decision point within the one or more musical sequences. The sound driver conditionally responds to the interpreted decision points depending on the unpredicted actions and events initiated by the directing system. It is also contemplated that the directing system may directly query the state of the sound driver and adjust the activities of the directing system based on the results of the query. Other direct commands may be initiated by the directing system for controlling the performance of the sound driver.

32 Claims, 19 Drawing Sheets

METHOD AND APPARATUS FOR DYNAMICALLY COMPOSING MUSIC AND SOUND EFFECTS USING A COMPUTER ENTERTAINMENT SYSTEM

FIELD OF THE INVENTION

The present invention relates to a method and apparatus for dynamically composing music and sound effects using a computer-controlled sound system. The present invention applies to, but is not limited to, a music and sound effects system in which music and sound effect composition is related to an interactive computer/video game and is dynamically composed in response to unpredictable action and events of the game and in which the changes occur in a way that is aesthetically appropriate and natural. The present invention may also be used in any other situation where dynamic music composition may be of benefit, including but not limited to live theater or musical performance, interactive computer education products, composition tools for quickly assembling soundtracks to accompany visual media, etc.

BACKGROUND OF THE INVENTION

Although it may potentially be used in many other applications, the present invention was created in response to a need in the computer/video games industry. In the past several years there has been a dramatic growth in the computer/video games industry which has been due primarily to the increased availability and technical advances of personal computers and video entertainment technology. The price/performance of personal computers and video entertainment technology has improved to a point where they can be found in virtually every home and business. Additionally, the quality and realism of computer game images is rapidly approaching that of film or camera-generated pictures, further enhancing the enjoyment and excitement of the games.

In fact, in certain elementary respects a modern computer game is similar to a motion picture. Both a motion picture and a computer/video game consist of a sequence of images which are viewed using some form of imaging medium. Both use a sound track comprised of music and sound effects to accentuate the feel and mood of the action and storyline. However, the story or action in many of the more sophisticated computer/video games can be changed interactively by a user so that the outcome of the game is determined partially or completely by the user. Thus, the computer game is essentially comprised of a number of interwoven plot or action segments, with the overall experience assembled from these segments.

For example, the computer game "Wing Commander", available from Origin Systems, Austin, Texas, is an interactive space adventure in which the user plays the part of one of the characters of the story. Accordingly, the user engages in dialogue and action with other game characters by making appropriate choices from menus of options, and by directing the flight of a spaceship in space combat. Whether or not the universe is saved from evil forces is determined by the menu choices selected by the user and the flight skill of the user. However, the aesthetic coordination of the music and sound effects with the game action in Wing Commander, as in other existing games, results in many instances of random musical juxtapositions which often sound abrupt and unnatural rather than musically graceful. Wing Commander is representative of the current state of the art of computer game technology.

Although music and sound effects are an important part of the game's "feel," the technological progress which has been made in this area has been relatively limited. The use of technology from the music industry, such as synthesizers and the Musical Instrument Digital Interface (MIDI), has yielded an increase in the quality of the composition of music in computer entertainment systems, however, there has been little technological advancement in the intelligent control needed to provide automated music composition which changes gracefully and naturally in response to dynamic and unpredictable actions or the "plot" of the game.

The most advanced music systems currently available for inclusion in computer entertainment systems are MIDI-based systems which provide only a small subset of the features included in many of the stand-alone software "sequencers" used in the music industry. A sequencer is basically a software tape player, except that instead of converting stored sound waveforms into sound, a sequencer interprets stored musical performance data and issues corresponding commands to sound generating hardware. An existing music industry product which represents the most advanced sequencer technology currently available is Performer, a product of Mark of the Unicorn, Cambridge, Massachusetts.

The MIDI-based music systems in existing computer entertainment systems, although software controllable unlike the above-mentioned stand-alone sequencer, are relatively limited. The limitations with these systems derive primarily from the structure of existing music files, coupled with the relatively simple architecture of the way the music playback system operates. Existing music sound files, while containing multiple channels of performance data, do not contain any provisions for branching or conditional messages, nor can the playback system be re-configured to respond differently to the performance data. Thus, existing systems cannot make compositional decisions based upon action of the game, but can only play the music in one way as determined by the stored performance data. By contrast, a motion picture sound track is scored by a composer in response to what the composer aesthetically perceives about the film's events, action, and movement.

In scoring a motion picture, a composer uses a combination of live musicians and electronic instruments to assemble the eventual sound track. The composer creates and modifies the music while watching the motion picture, thus creating a sound track which is an integral part of the viewing experience. Often, several versions of the music are composed, and the director of the motion picture selects the final version during post-production by using segments of music from each of the earlier composed versions.

In existing computer entertainment systems, the music is precomposed and stored as musical sequences (human composed music tends to be far more evocative than algorithmic music). These sequences are generally based on a standard MIDIfile format or variations thereof. A MIDIfile contains performance data representing a sequence of musical notes to be played. The performance data specifies the time between one note and the next, and the MIDI channel (i.e. instrument selection, such as trumpet or violin) for each note. There may also be other performance parameters specified by the data, such as volume changes which are to occur at a particular place in the music. A standard MIDI sequence essentially describes a musical performance, performed by up to sixteen different instruments playing in parallel, which is played in essentially a linear manner from beginning to end.

MIDI performance data is interpreted by what is basically a software tape player, or sequencer. A sequencer reads through a MIDIfile, pausing between each MIDI message for a period of time specified by the data in the file. Each time it proceeds to a new message, the message is decoded and an appropriate command is sent to a synthesizer to produce the actual sound.

In the existing systems, the sequencers read through MIDI sequences in the simplest way: they start at the beginning of the sequence and read forward until they reach the end. (In some cases, when a sequencer reaches the end of a sequence, it automatically restarts from the beginning. This is called "looping", and allows a sequence to be repeated indefinitely.) The sequencer path is essentially linear, in that no provisions are made within the MIDIfile format for branches, and the sequencer is not capable of jumping to arbitrary time points within the sequence. Thus, in existing systems, the ability of the host to control the sequencer, and thereby compose the actual music played is limited to starting a sequence at the beginning, and stopping it at any time before it reaches the end.

Considering these limitations, it is easy to see why the musical flow suffers in existing computer entertainment systems when the music is required to change from one sequence to another. For example, suppose that there is a high-energy fight scene occurring in the game which, at any time, may end in either victory or defeat. In existing systems there would likely be three music sequences: fight music (looped), victory music, and defeat music. When, the fight ends, the fight music would be stopped, and either victory or defeat music would be started. The switch from the fight music to the victory or defeat music occurs without taking into account what is happening in the fight music leading up to the moment of transition. Any musical momentum and flow which had been established is lost, and the switch sounds abrupt and unnatural.

A further limitation of existing systems is that the synthesizer responds to the MIDI commands in the most direct fashion; it plays the notes which the composer has sequentially placed in the MIDI sequence. This literal interpretation of MIDI commands precludes an entire category of dynamic music composition, i.e. allowing the computer entertainment system to make dynamic changes to the way in which the performance data are interpreted, resulting in aesthetically appropriate variation in the music while the game is playing, thereby tailoring the texture, mood, and intensity of the music to the action in the game.

Thus, existing music systems do not provide the ability for the computer entertainment system to tell the music system how to intelligently and artistically respond to the events and action of the game. There is needed a music and sound effects system which can be included in a computer-controlled sound system including a computer entertainment system, and which creates natural and appropriate music composition that changes dynamically with the events and action of the game in response to commands from the sound system.

SUMMARY OF THE INVENTION

Briefly, the present invention provides a computer-based music and sound effects system in which music and sound effects are composed dynamically in response to the action of a directing system. The resulting music and sound effects reflect the dynamic and unpredictable requests of the directing system by changing texture, mood and character in a way which is aesthetically appropriate and natural.

In a preferred embodiment, the present invention consists of a sound driver and a means for creating a composition database. Under the control of the directing system, the sound driver interprets the composition database in order to play music and sound effects. In order to allow the directing system to control the sound driver effectively, the composer provides the directing system or its programmer with a set of control instructions, which are the various choices and strategies available for controlling the sound driver. In addition, the directing system may also query the state of the sound driver, and adjust its own activity based on the results.

In controlling the sound, the directing system can initiate two kinds of actions. The first action is selecting which performance data is interpreted by the sound driver at any given time. The second action is determining the way in which the sound driver interprets the performance data. Furthermore, the directing system exercises this control in two ways. The first is by direct command, in which case the control is effective immediately. The second is by setting conditions. As such, it deserves closer examination, starting with the composition database.

The composition database consists of musical performance data created a priori by the composer, containing within it any number of decision points. Decision points are places in the performance data, specified by the composer, at which any of several actions may be aesthetically appropriate. Upon encountering a decision point, the sound driver evaluates corresponding conditions which have been set by the directing system, and determines what actions to take.

Regardless of when the conditions were set, the corresponding actions do not take place until the next associated decision point is encountered by the sound driver. The performance data and the decision points thus comprise a composing decision tree, with the decision points marking places where branches may occur.

First, the composition database is formed by the composer, and is comprised of one or more soundfiles consisting of sequences of standard and custom MIDI messages. The standard MIDI messages are the previously discussed performance data which describes a musical performance of up to 16 instruments. The custom messages are included under the "system exclusive" format provided in the MIDI specification, which allows custom messages to be embedded within standard MIDI data. Most of the custom messages, further described below, are conditional and thus allow dynamic and unpredictable requests of the directing system to be reconciled with the composer's aesthetic requirements of the musical flow, thus providing musical responsiveness without a loss of musical grace. Since the custom messages are conditional, they are not responded to unless the specific condition predetermined by the composer and enabled by the directing system is satisfied.

The preferred embodiment of the present invention provides a sequencer to extract musical performance data from a soundfile at a rate determined by the musical tempo, and to pass the performance data to the rest of the sound driver. Specifically, the sequencer is provided with the capability to jump to any arbitrary point within a sequence. This allows the start and end points of loops to be located anywhere in the sequence, not just at the beginning or end. More important, it allows the composition database to contain conditional jump points in a manner further explained below. The linear nature of the music sequence playback in existing systems is thus overcome by the present invention, by allowing the music sequence to aesthetically and appropriately branch and converge in an interwoven set of paths (which have all been chosen a priori by the composer and placed in the composition database in the form of decision points), according to the dynamic requests from the directing system.

The way the sound driver of the preferred embodiment interprets MIDI messages can be dynamically configured by the directing system, allowing the directing system to tailor the texture, mood, and intensity of the music in real time. The preferred embodiment allows the directing system to dynamically control the process, volume, pan, transpose, detune, and playback speed of a sound, and it can enable, disable, or set the volume of particular instrument parts within the sound. This can be done either directly for immediate response, or using conditional messages for a greater degree of coordination between the directing system's requests and the musical flow.

To accomplish control using conditional messages, custom MIDI messages of two general types are provided: hooks and markers. Both hooks and markers carry an identification, or "id" number which is eventually compared to a corresponding value set by the directing system. More specifically, each time a hook or marker message is encountered in the musical sequence being played, it is compared with its corresponding value. If there is no match the message is ignored. If there is a match, a prespecified musical action occurs.

In the case of hooks, the musical action is specified within the hook message itself (i.e. the type of hook specifies the action and is chosen a priori by the music composer). The actions which may be specified by hooks include but are not limited to the following: jump to a different location within the music sequence, transpose the entire sequence or an individual instrumental part, change the volume or instrument selection of an instrument part, or turn an instrument part on or off.

In the case of markers, the action is specified by the directing system. When the directing system enables a marker, it does so by placing a trigger and any number of commands into a command queue. A trigger specifies a particular sound and marker_id, and is followed by one or more commands. It is important to note that any command, which the directing system could normally issue in real time, can be deferred to the next musically appropriate moment by being placed in the command queue. When a sound being played matches the sound specified by the trigger, and a marker having the correct marker id is next encountered in the MIDI sequence, the commands which follow the trigger in the command queue are executed.

With both hooks and markers, the directing system is able to initiate changes in the music, but the actual changes occur at points in the sequence which are aesthetically correct because the points and associated actions have been carefully chosen a priori by the composer and stored in the composition database.

To illustrate the advantages of the present invention, consider again the previous example of a fight scene in a computer digital/video (analog to digital) game running on a entertainment system. As before, there are three music sequences: fight music (looped), victory music and defeat music.

The fight music, rather than playing along unresponsively, can be made to change mood of the game in response to the specific events of the fight. For example, certain instrument parts can signify doing well (for example, a trumpet fanfare when a punch has been successfully landed), while others can signify doing poorly (for example, staccato strings when the fighter has taken a punch). Enabling and disabling the appropriate instrument parts can be done either immediately under entertainment system control, or if parts need to be enabled or disabled only at particular points in the music sequence, then hook messages are used. Also, it may be desirable to transpose (i.e., change the key) the music as the fight reaches its climax. This can also be done either immediately under entertainment system control, or by hook message (if it is necessary that the transposition occur only at an appropriate point in the music sequence). The resulting fight music will change mood and character along with the intensity and excitement of the fight, but in a smooth and aesthetically natural way, much like the music would follow the action in a feature length motion picture.

When the fight ends, the fight music may be playing at any point within the sequence. Rather than simply stopping the fight music and starting the victory or defeat music abruptly, which typically occurs in existing systems and results in an unnatural and choppy transition, the present invention allows for a more musically graceful transition.

Within the present invention, the composer creates a number of transitional music phrases, each providing a smooth transition from a different point in the fight music to either victory or defeat music, and each transitional sequence having a marker message at the end. More particularly, the transitional sequences are normally composed so that at one or more decision points in the fight music, there is a transition which can lead naturally to victory music and another which can lead naturally to defeat music. At each of these points in the fight music, two jump hook messages are placed. One specifies a jump to the transition to victory music, the other specifies a jump to the transition to defeat music. All of the jump hook messages for victory share a specific hook_id value. Similarly, all of the jump hook messages for defeat share different hook_id value.

When the fight ends, the entertainment system enables the hook_id for either the victory jump hooks or the defeat jump hooks. A trigger is placed into a command queue which specifies the marker_id number of the markers located at the end of the transitional phrases and a command is also placed into the command queue which starts either the victory or defeat music.

More particularly, at the end of the fight for example, a match in hook_id number occurs for one of the jump hook messages, and the sequencer jumps to the appropriate transitional phrase as earlier specified by the composer during the design of the composition database. As the transitional music plays a marker message is encountered at the end of the transitional music. Assuming the marker_id of the marker message matches the value of the trigger in the command queue, the command in the command queue is executed and either the victory music or defeat music is started as the transitional music ends. The result is a smooth, natural transition from the fight music to either victory or defeat music.

These as well as more detailed aspects of the invention, along with its various features and advantages, will be understood from the following description of the preferred embodiments read in conjunction with the accompanying drawings.

BRIEF DESCRIPTION OF THE DRAWINGS

FIG. 1(*b*) is a diagram of the track chunk format of a standard MIDIfile.

FIG. 1(*c*) is a diagram of the file format of a soundbundle in accordance with the preferred embodiment of the present invention.

FIG. 1(*d*) is a diagram of the format of a specialized header chunk in accordance with the preferred embodiment of the present invention.

FIG. 4(*b*) is a diagram demonstrating the effect of a scan command on a sustaining note in accordance with the preferred embodiment of the present invention.

DETAILED DESCRIPTION OF THE PREFERRED EMBODIMENTS CONTENTS

Figure 1A:
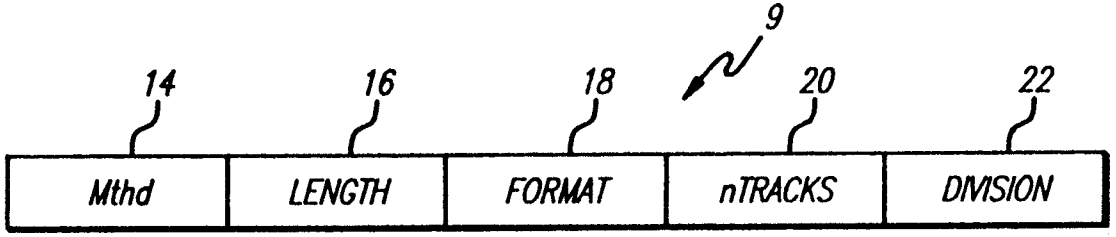
FIG. 1(a) PRIOR ART
FIG. 1(*a*) is a diagram of the header chunk format of a standard MIDIfile.
Figure 1B:
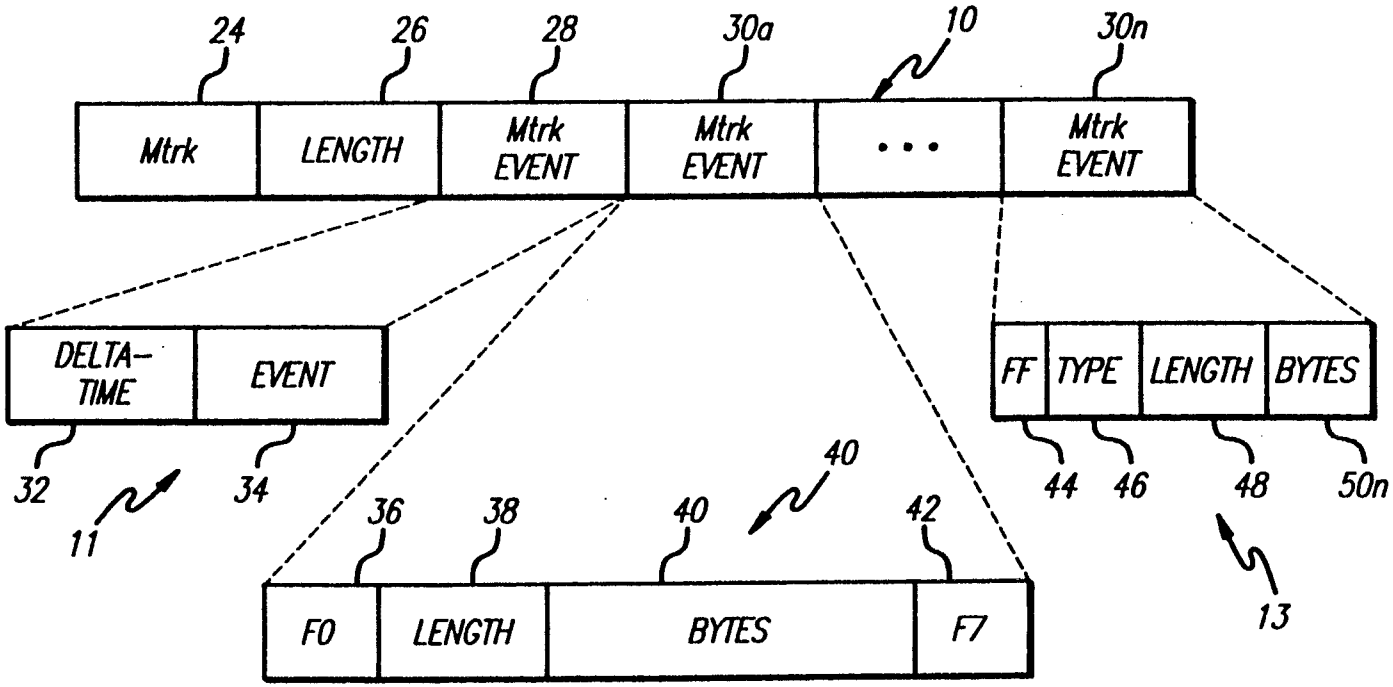
FIG. 1(b) PRIOR ART
Figure 1C:
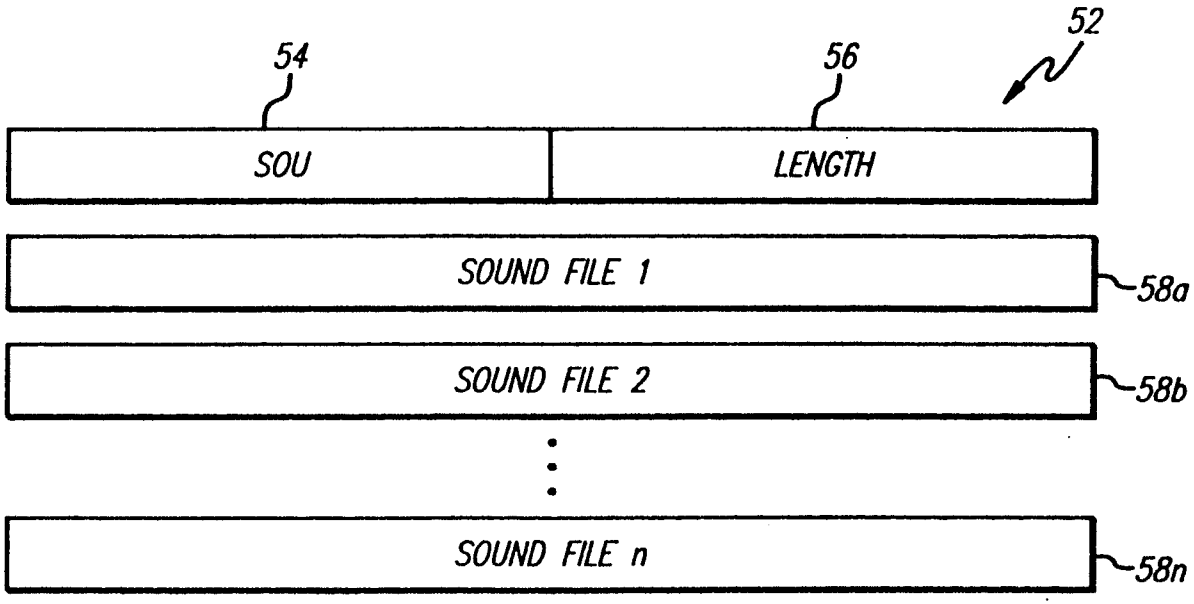
Figure 1D:
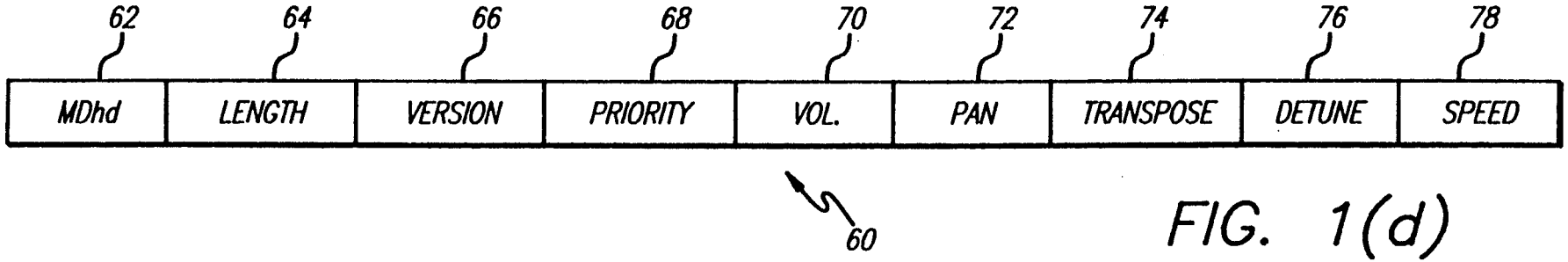

1. GLOSSARY OF TERMS
2. OVERVIEW OF THE PREFERRED EMBODIMENTS
3. MIDI SPECIFICATION AND FILE FORMAT
   a. Standard MIDI File Format
   b. Enhancements to Standard File Format in the present invention
   c. MIDI messages supported by the present invention
4. COMMAND SPECIFICATION AND ARCHITECTURE
   a. Command Descriptions
      (1) General Commands
      (2) MIDI Commands
   b. Sound Driver Description
   c. Sound Driver Operation
5. COMPOSITION DATABASE FORMATION AND UTILIZATION
   a. Composing and Conditionalizing MIDI Sequences
   b. Example: Assembling a Sound Track

1. GLOSSARY OF TERMS

In order to discuss more clearly the technology of the present invention, the following definition of terms may be useful:

Directing System—the system which controls the operation of the present invention; more particularly, an independently created computer program to which the software of the present invention is linked, or a person (e.g. player of a game) or person using the independently created computer program. The directing system makes real-time choices about the mood, character and direction of the music, and its choices are implemented by the present invention in a musically appropriate and natural way.

Composition Database—created a priori to the events and action requested by the direction system; a database for storing not only music performance data, but also conditional messages which the present invention uses in order to implement the choices of the directing system.

Composer—the creator of the composition database.

Sound Driver—a computer software program which is linked to the directing system and which uses the musical performance data contained in the composition database to play music and sound effects by driving sound hardware. It navigates through the composition database and interprets the performance data according to the demands of the directing system.

Control Instructions—instructions given by the composer to the directing system, or programmer thereof, in order to enable the directing system to appropriately control the sound driver.

Conditionalizing—the process by which the composer provides options for conditionally selecting and interpreting the performance data in the composition database. Conditionalizing may also include modifying the performance data to accommodate those options.

Sequence—a time-stamped stream of musical performance data, intended to be played as a single musical entity; i.e. a phrase, an ending, an entire piece, etc. Sequences contain one or more channels of independent performance data meant to be played simultaneously. Sequences may be interlinked in various ways; however, each sequence is conceptually self-contained.

Decision Point—a place in a sequence, determined a priori, at which the sound driver determines what action to take based upon conditions set by the directing system.

Soundfile—A collection of one or more sequences, in a computer file format which can be interpreted by the sound driver. A collection of one or more soundfiles constitutes the composition database, with each soundfile being performed by a unique "sound number."

Sound—a soundfile which is in the process of being played by the sound driver.

Sequencer—the part of the sound driver which extracts musical performance data from a soundfile at a rate determined by the musical tempo, and passes the data to the rest of the sound driver for interpretation.

Player—an element within the sound driver which maintains the playback state of a sound. The sound driver contains several players, any or all of which may be playing a different sound at any given time. Each player is associated with its own sequencer, forming several player-sequencer pairs.

Instrument Part—an element within the sound driver which responds to performance data and drives sound hardware. Instrument parts are dynamically allocated to players, and are assigned channels corresponding to the channels in a sequence. Each instrument part responds only to performance data on its given channel, and plays notes with only a single timbre at a time (such as piano or violin). An instrument part is analogous to a single instrumentalist in an orchestra, reading a single line from an orchestral score.

Synthesizer—sound generating hardware driven by the sound driver.

Synthesizer Driver—the part of the sound driver which is customized for driving a particular kind of synthesizer hardware. The synthesizer driver receives generic music performance commands from the instrument parts, and translates them into hardware-specific commands to drive the synthesizer.

2. OVERVIEW OF THE PREFERRED EMBODIMENTS

The preferred embodiment of the present invention is a method and apparatus for dynamically composing a music sound track in response to dynamic and unpredictable requests from a directing system. The preferred embodiment includes: a composition database for containing musical performance data and one or more conditional messages; a sound driver for interpreting the performance data and conditional messages; and a synthesizer for generating the music and sounds. The preferred embodiment of the invention also includes a method for forming the composition database and sound driver, and for utilizing both. The methods for forming and utilizing includes steps for providing options for the conditional selection and interpretation of the performance data, steps for modifying the data and steps for adding conditional messages to accommodate those options, and steps for providing a set of cover instructions to the directing system to enable it to control the sound driver properly. The method allows the apparatus to compose a sound track dynamically in response to requests from the directing system.

3. MIDI SPECIFICATION AND FILE FORMAT a. Standard MIDIfile Format

Before discussing the operation of the preferred embodiments, the standard structure and composition of the composition database, which is based upon the standard MIDIfile format and specification, is now discussed. Complete details of the MIDI specification and file format used in forming the composition database of the preferred embodiment may be found in the MIDI 1.0 DETAILED SPECIFICATION (June 1988) and the STANDARD MIDI FILES 1.0 (July 1988), both of which are available from The International MIDI Association, Los Angeles, California, and the entire disclosures of both are hereby incorporated by reference.

Consider first the structure and use of a standard MIDI sound file. The purpose of MIDI sound files is to provide a way of exchanging "time-stamped" MIDI data between different programs running on the same or different computers. MIDIfiles contain one or more sequences of MIDI and non-MIDI "events", where each event is a musical action to be taken by one or more instruments and each event is specified by a particular MIDI or non-MIDI message. Time information (e.g. for utilization) is also included for each event. Most of the commonly used song, sequence, and track structures, along with tempo and time signature information, are all supported by the MIDIfile format. The MIDIfile format also supports multiple tracks and multiple sequences so that more complex files can be easily moved from one program to another.

Within any computer file system, a MIDIfile is comprised of a series of words called "chunks". FIGS. 1(*a*) and 1(*b*) represent the standard format of the MIDIfile chunks with each chunk (FIG. 1*a* and 1*b*) having a 4-character ASCII type and a 32-bit length. Specifically the two types of chunks are header chunks (type Mthd 14, FIG. 1(*a*)) and track chunks (type Mtrk 24, FIG. 1(*b*)). Header chunks provide information relating to the entire MIDIfile, while track chunks contain a sequential stream of MIDI performance data for up to 16 MIDI channels (i.e. 16 instrument parts). A MIDIfile always starts with a header chunk, and is followed by one or more track chunks.

Referring now to FIG. 1(*a*), the format of a standard header chunk is now discussed in more detail. The header chunk provides basic information about the performance data stored in the file. The first field of the reader contains a 4-character ASCII chunk type 14 which specifies a header type chunk and the second field contains a 32-bit length 16 which specifies the number of bytes following the length field. The third field, format 18, specifies the overall organization of the file as either a single multi-channel track ("format 0"), one or more simultaneous tracks ("format 1"), or one or more sequentially independent tracks ("format 2"). Each track contains the performance data for one instrument part.

Continuing with FIG. 1(*a*), the-fourth field, ntracks 20, specifies the number of track chunks in the file. This field will always be set to 1 for a format 0 file. Finally, the fifth field, division 22, is a 16-bit field which specifies the meaning of the event delta-time; the time to elapse before the next event. The division field has two possible formats, one for metrical time (bit 15=0) and one for time-code-based time (bit 15=1). For example, if bit 15=0 then bits 14 through 0 represent the number of delta-time "ticks" that make up a quarter note. However, if bit 15=1 (for example) then bits 14 through 0 specify the delta-time in sub-divisions of a second in accordance with an industry standard time code format.

Referring now to FIG. 1(*b*), the format of a standard track chunk 10 is now discussed. Track chunk 10 stores the actual music performance data, which is specified by a stream of MIDI and non-MIDI events. As shown in FIG. 1(*b*), the format used for track chunk 10 is an ASCII chunk type 24 which specifies the track chunk, a 32-bit length 26 which specifies the number of MIDI and non-MIDI events of bytes 28–30*n* which follow the length field, with each event 34 proceeded by a delta-time value 32. Recall that the delta-time 32 is the amount of time before an associated event 34 occurs, and it is expressed in one of the two formats as discussed in the previous paragraph. Events are any MIDI or non-MIDI message, with the first event in each track chunk specifying the message status.

An example of a MIDI event can be turning on a musical note. This MIDI event is specified by a corresponding MIDI message "note_on". The delta-time for the current message is retrieved, and the sequencer waits until the time specified by the delta-time has elapsed before retrieving the event which turns on the note. It then retrieves the next delta-time for the next event and the process continues.

Normally, one or more of the following five message types is supported by a MIDI system: channel voice, channel mode, system common, system real-time, and system exclusive. All five types of messages are not necessarily supported by every MIDI system. Channel voice messages are used to control the music performance of an instrumental part, while channel mode messages are used to define the instrument's response to the channel voice messages. System common messages are used to control multiple receivers and they are intended for all receivers in the system regardless of channel. System real-time messages are used for synchronization and they are directed to all clock-based receivers in the system. System exclusive messages are used to control functions which are specific to a particular type of receiver, and they are recognized and processed only by the type of receiver for which they were intended.

For example, the note_on message of the previous example is a channel voice message which turns on a particular musical note. The channel mode message "reset_all_controllers" resets all the instruments of the system to some initial state. The system real time message "start" commands synchronizes all receivers to start playing. The system common message "song_select" selects the next sequence to be played.

Each MIDI message normally consists of one 8-bit status byte (MSB=1) followed by one or two 8-bit data bytes (MSB=0) data bytes which carry the content of the MIDI message. Note however that system exclusive and system real-time messages may have more than two data bytes. The 8-bit status byte identifies the message type, that is, the purpose of the data bytes that follow. In processing channel voice and channel mode messages, once a status byte is received and processed, the receiver remains in that status until a different status byte from another message is received. This allows the status bytes of a sequence of channel type messages to be omitted so that only the data bytes need to be sent and processed. This procedure is frequently called "running status" and is useful when sending long strings of note_on and note_off messages, which are used to turn on or turn off individual musical notes.

For each status byte the correct number of data bytes must be sent, and the receiver normally waits until all data bytes for a given message have been received before processing the message. Additionally, the receiver will generally ignore any data bytes which have not been preceded by a valid status byte.

FIG. 1(*b*) shows the general format for a system exclusive message 12. A system exclusive message 12 is used to send commands or data that is specific to a particular type of receiver, and such messages are ignored by all other receivers. For example, a system exclusive message may be used to set the feedback level for an operator in an FM digital synthesizer with no corresponding function in an analog synthesizer.

Referring again to FIG. 1(*b*), each system exclusive message 12 begins with a hexadecimal F0 code 36 followed by a 32-bit length 38. The encoded length does not include the F0 code, but specifies the number of data bytes 40*n* in the message including the termination code F7 42. Each system exclusive message must be terminated by the F7 code so that the receiver of the message knows that it has read the entire message.

FIG. 1(*b*) also shows the format for a meta message 13. Meta messages are placed in the MIDIfile to specify non-MIDI information which may be useful. (For example, the meta message "end_of_track" tells the sequencer that the end of the currently playing soundfile has been reached.) Meta message 13 begins with an FF code 44, followed by an event type 46 and length 48. If Meta message 13 does not contain any data, length 48 is zero, otherwise, length 48 is set to the number of data bytes 50*n*. Receivers will ignore any meta messages which they do not recognize.

b. Enhancements to Standard MIDI File Format

The preferred embodiments of the present invention use the standard MIDIfile format with two important structural enhancements. First, the MIDI soundfiles may exist either independently or they may be grouped together into a larger file called a "soundbundle". FIG. 1(*c*) shows the format of a soundbundle 52 which contains multiple versions of the same soundfile orchestrated for different target hardware. Preferred versions of the soundfile are located closer to the front of the soundbundle, so that in cases in which the hardware is capable of playing several versions, the preferred versions will be found first.

The second structural enhancement to the MIDI soundfiles implemented by the present invention is a specialized header chunk 60, as shown in FIG. 1(*d*). Specialized header chunk 60 is located at the beginning of the soundfile, and provides default performance parameters to MIDI module 110. The default performance parameters provide a convenient control mechanism for initializing the basic parameters required for the playback of a particular soundfile. As with standard header chunks, the first field of the specialized header chunk 60 (FIG. 1(*d*)) contains a 4-character ASCII type 62 specifying the specialized header chunk and the second field contains a 32-bit length 64 which specifies the number of bytes (i.e. nine) following length 64. The third field, "version", is a 16-bit identifier 66 which specifies the hardware version of the soundfile. The fourth field, "priority", is an 8-bit identifier 68 which specifies the playback priority of the soundfile relative to others which are currently playing. Since several soundfiles may be played simultaneously, the soundfiles must be prioritized, with those having a higher priority obtaining access to the sequencers and synthesizer hardware first. The remaining fields are each 8-bits in length and contain the default performance parameters, including volume 70, pan 72, transpose 74, detune 76, and speed 78. The functions of these parameters will be further discussed in the command descriptions section of this specification.

c. MIDI Messages Supported By the Present Invention

Recall that there are five major types of MIDI messages that may be utilized in MIDIfiles. The preferred embodiment of the present invention supports the MIDI messages are shown in Table 1, which are only a subset of the MIDI messages defined in the earlier referenced MIDI specification. The composition database of the preferred embodiment, comprised of one or more MIDIfiles or sound bundles, is created by the composer and contains sequences of MIDI messages from Table 1.

TABLE 1

| MIDI AND META MESSAGES SUPPORTED | |
|---|---|
| note_on | |
| note_off | |
| program_change | Channel Voice |
| pitch_bend | |
| controller | |
| part_alloc | |
| bulk_dump | |
| param_adjust | System Exclusive Messages |
| hook | |
| marker | |
| loop | |
| tempo | |
| end_of_track | META Messages |

Referring now more particularly to Table 1, the first five messages as shown are channel voice messages and they are defined in detail in the above-referenced MIDI specification. A brief description of each of these messages is now presented. The message "note_on", as previously discussed, is used to activate a particular musical note by sending a numerical value representing the note. Each note of the musical scale is assigned a numerical value ranging between 0 and 127, with middle C having, for example, a reference value of 60. Included in the note_on message is is the channel designation (i.e., 1 through 16) for which the note is intended.

The message "note_off" is used to deactivate a particular note. The note_off message is sent with a numerical value and the designation channel which serves to identify the specific note to be deactivated. A note may also be deactivated by sending a note_on message with the numerical value of a currently playing note, along with a channel designation and a velocity value of zero. The velocity defines the intensity of the note, and a velocity value of zero is interpreted as a note off. This latter approach is especially useful when employing "running status," since notes can be turned on and off using only the note_on message with different velocity values.

The message "program_change" is used to send a program number (for specifying a particular instrument sound) when changing sounds on a particular instrument part. A program_change message is usually sent when the composer wishes to physically select a new instrument type for the instrument part. Pitch_bend is a special purpose controller used by the composer to smoothly vary the pitch of an instrument. The pitch bend_message is always sent with 14-bit resolution in order to account for the human sensitivity to pitch changes.

The "controller" message is a general-purpose controller used to vary some aspect of the musical performance. A controller message is sent with two data bytes, the first specifying the controller number, and the second specifying the controller value. The MIDI specification provides for 121 general-purpose controllers, the functions of some of which have been preassigned (i.e. controller 7=instrument volume; controller 64=sustain pedal). Depending on the function of the controller, the value byte may be used as either a variable (0–127), or a switch (0="off", 127="on"). Controller numbers greater than 120 are reserved for the previously discussed channel mode messages in the preferred embodiment these controller-numbers are ignored.

Continuing with Table 1, the next six messages (i.e. part_alloc, bulk_dump, param_adjust, hook, marker and loop) are system exclusive messages for specific use with the preferred embodiment of the present invention. These messages are not present in the standard MIDI format. The first message, "part_alloc," is used to assign or unassign an instrument part to receive the messages specified by the performance data of a specific MIDI channel. When using part_alloc to allocate an instrument part, the following parameters are typically specified in the message: part enable, priority offset, volume, pan, transpose, detune, pitch bend range, and program number.

Next, the message "bulk_dump" is used to simultaneously send all of the parameters (i.e. volum, pan, transpose, etc.) required to create a particular instrument sound. Bulk_dump can also be used to store a group of parameters which can later be recalled as a group by referencing a setup number. The specific parameter list or subset thereof sent or stored by bulk_dump depends upon the particular synthesizer being used. The message "param_adjust" is used to change the value of a particular instrument parameter. A parameter select message for identifying the particular-parameter being adjusted, and an adjusted parameter value, are sent by param_adjust.

The "loop" message is used by the composer to set loop points for the playback of a sequence. It is embedded by the composer in the performance data during the formation of the composition database. The loop message specifies the start and end points of the loop, and the number of loop repetitions.

Of key importance is the composer's placement and use of the hook and marker messages. When the composer designs the music sequences in the composition database he/she places the hook or marker messages at specific decision points where musical transitions, events or other changes are likely to occur. For example, at a given point in the music sequence the composer may believe that it is necessary to conditionally jump to a different location in the sequence, transpose the entire sequence, or jump to a different sequence. In addition, it may be necessary to conditionally transpose an instrument part, change the volume of any instrument part, change instrument selection of an instrument part, or turn an instrument part on or off.

Hook and marker messages are provided to allow the performance of conditional control at decision points. Both carry an identification, or "id" number which is eventually compared to a corresponding value set by the directing system depending on the type of action encountered. More specifically, each time a hook or marker message is encountered in the musical sequence being played, it is compared with its corresponding value. If there is no match the message is ignored. If there is a match, a prespecified musical action occurs.

In the case of hook messages, the musical action is specified within the hook message itself (i.e. set a priori by the composer to jump to a different location within the music sequence, transpose the entire sequence or an individual instrumental part, change the volume or instrument selection of an instrument part, or turn an instrument part on or off, etc., depending on the actions of the directing system).

In the case of marker messages, the action is specified by the directing system. When the directing system enables a marker message, it does so by placing a trigger and any number of commands into a command queue. A trigger specifies a particular sound and marker_id, and is followed by one or more commands. Any command, which the directing system could normally issue in real time, can be deferred to the next musically appropriate moment by being placed in the command queue. When a sound being played matches the sound specified by the trigger, and a marker having the correct marker id is next encountered in the MIDI sequence, the commands which follow the trigger in the command queue are executed.

Additional functions of other messages supported by the preferred embodiment of the present invention will be discussed in more detail in conjunction with the following description of the architecture of the preferred embodiment of the present invention.

4. COMMAND SPECIFICATION AND ARCHITECTURE a. Command Descriptions

Figure 2:
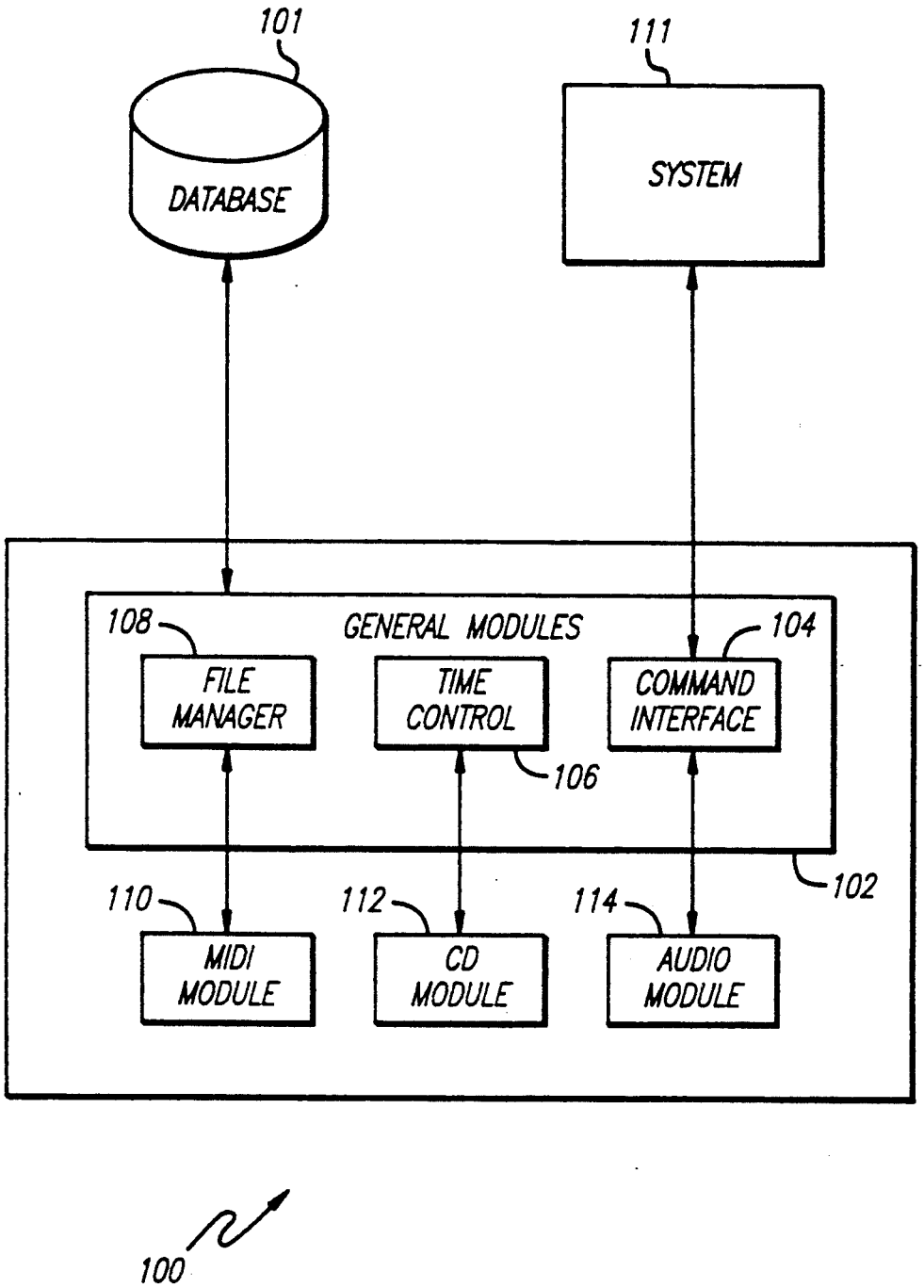
FIG. 2 is a block diagram of an apparatus for performing operations in accordance with the preferred embodiment of the present invention.

Referring to FIG. 2, an apparatus 100, also known as a "sound driver", consists of general modules 102 which perform a variety of general-purpose functions, and "soundtype" modules which are responsible for interpreting the type of sound file being performed. MIDI module 110, which interprets MIDI-based sound files, is the only soundtype module implemented in the preferred embodiment. However, it is contemplated that other soundtype modules, such as CD module 112 and audio module 114 may also be implemented by the preferred embodiment.

More particularly, referring to FIG. 2, all commands from a directing system 111 are routed to a command interface module 104 which, in turn, routes them to other functional modules of apparatus 100 as necessary. Commands from directing system 111 are used to control the composition and playing of the music, and to set performance parameters such as volume, transposition, and instrumentation. In the preferred embodiment, all commands are called by directing system 111 using a single function—named "sound_call( )". The first argument to sound_call( ) is a hexadecimal command code identifying a particular sound driver command (e.g., one of the general or MIDI commands to be discussed) presently called.

The commands of the preferred embodiment of the present invention consist of general commands and module-specific commands. The general commands are those listed in Table 2 (below) which affect the overall function of apparatus 100, or any one or all of the soundtype modules (i.e. MIDI module 110, CD module 112, or audio module 114). Module-specific commands are those listed in Table 3 (below) and are intended for MIDI module 110 of FIG. 2. Since the commands are closely interrelated, their function will be described with reference to Tables 2 and 3, along with the functional modules and architecture of FIGS. 2 and 3. A specific operational example will also be discussed with module-specific commands limited to the MIDI commands.

(1) General Commands

The general commands of Table 2 are now reviewed. Recall that general commands are those which apparatus 100, or any one or all of its soundtype modules (i.e., MIDI module 110, CD module 112, and audio module 114) may respond.

TABLE 2

GENERAL COMMANDS initialize (ptr)
terminate 0
pause 0
resume 0
save_game (addr, size)
restore_game (addr)
set_master-vol (vol)
get_master vol 0
start_sound (sound_number)
stop_sound (sound)
stop_all_sounds ( )
get_sound_type (sound)
get_play_status (sound)

The command initialize is used to initialize all modules of apparatus 100, while the command terminate is used to de-initialize (or turn off) all modules of apparatus 100. These commands are used by directing system 111 to place each of the soundtype modules (110, 112 and 114) in a proper state for beginning operation.

The next two general commands, pauses( ) and resume( ), are used to pause or resume the activity of all soundtype modules. The pauses( ) command is generally called when the activity of directing system Ill requires apparatus 100 to temporarily stop processing data. For example, when a soundfile that is currently being played needs to be moved from one memory location to another, the music is paused while the movement occurs. The music is then resumed by calling resume ( ).

The next two general commands are processed by command interface 104. The set_master_volume( ) command is used by directing system 111 to set a master volume parameter for all soundtype modules, over a range of 0 (volume off) to 127 (full volume). The command get_master_vol( ) is similarly used to retrieve the current value of the master volume parameter so that the volume can be restored later to its previous value.

To determine the soundtype of a soundfile, the command get_sound_types( ), is provided by this command, which is processed by file manager 108, returns a code specifying the particular soundtype module for which the soundfile is intended: 00 for undefined, 01 for MIDI (110, FIG. 2), 02 for CD (112, FIG. 2), and 03 for audio (114, FIG. 2).

The command start_sound( ) is used to start playing a soundfile and the command stop_sound( ) is used to stop playing a soundfile. A "sound_number" parameter passed by the start sound( ) and stop_sound( ) commands identifies the specific soundfile to be played. When the actual address of the soundfile is needed, the sound_number is passed to file manager 108 which returns the address of the corresponding soundfile. This allows the soundfile to be relocated in memory.

If a soundfile being started by start_sound( ) is already playing, another iteration of the currently playing soundfile will be started and both iterations will play concurrently. There can be as many iterations playing concurrently as there are available player-sequencer pairs. Note that issuing a single stop_sound( ) command will stop all iterations of a given sound. Finally, the command get_play_status( ) returns information about whether or not a given sound is currently playing. The return values of get_play_status are: 0 not playing, 1 playing, and 2 not yet playing but a start_sound( ) command is enqueued in command queue 122.

(2) MIDI Commands

TABLE 3

MIDI COMMANDS md_set_priority (sound, priority)
md_set_vol (sound, vol)
md_set_pan (sound, pan)
md_set_transpose (sound, rel_flag, transpose)
md_set_detune (sound, detune)
md_set_speed (sound, speed)
md_jump (sound, chunk, beat, tick)
md_scan (sound, chunk, beat, tick)
md_set_loop (sound, count, start_beat, start_tick, end_beat, end_tick)
md_clear_loop (sound)
md_set_part_enable (sound, chan, state)
md_set_part_vol (sound, chan, vol)
md_set_hook (sound, class, val, chan)
md_fade_vol (sound_number, vol, time)
md_enqueue_trigger (sound, marker_id)
md_enqueue_command (param1 . . ., param7)
md_clear_queue ( )
md_query_queue (param)

Referring to Table 3 the MIDI commands are now discussed. Recall that the MIDI commands are those addressed specifically to MIDI module 110 and one or more of its functional modules. The command md_get_param( ) returns the value of a specified parameter of a specified sound to directing system 111. This allows the directing system to query the state of a sound's playback, and adjust its own activity based on the results. Note that inquiries which must specify individual instrument parts do so by referencing their MIDI channel number. The parameters which may be queried and the functional modules which handle the inquires are now reviewed. Priority, volume, pan, transpose, and detune of a sound are all parameters which are returned by players module 130. The speed of a sound's playback relative to the composer-defined tempo (with 128 meaning "as composed"), and the current playback location as defined by chunk, beat and tick, are returned by sequencers module 124. The current status of a sound's loop parameters, including the number of repetitions remaining, and the start and end points of the loop, are also returned by sequencers module 124. The enable/-disable state, volume, instrument number (as defined by the most recent MIDI program change), and transpose of the individual instrument parts of a sound are returned by parts module 130. The current values of the various hooks, including the jump hook, the transpose hook, the sixteen part enable hooks, the sixteen part volume hooks, the sixteen part program change hooks, and the sixteen part transpose hooks, are returned by hooks module 132.

The command md_set_priority( ) is used to set the playing priority of a sound which, as previously mentioned, is the basis for allocating players to sounds, instrument parts to players, and sound hardware to instrument parts. More particularly, since MIDI module 110 contains an undetermined but finite number of players available to play sounds, when a start_sound( ) command is issued a player is allocated to play the new sound if either: 1) there is a free player, or 2) the new sound has a priority greater than, or equal to, that of a currently playing sound. In the latter case, the new sound replaces a currently playing sound that has a lower, or equal, priority.

In addition, there are an undetermined number of instrument parts which are requested by the players when they encounter part_alloc messages embedded in the soundfile. Part allocation employs a logic similar to player allocation, except that each part_alloc message includes a signed priority offset. This offset is summed with the sound's overall priority to determine the priority of the individual part thereby allowing different instrument parts within a single sound to have different play priorities, ensuring that the most important melodies or sounds will always be heard.

The sound volume of an individual sound can be set using md_set_vol( ). The effective sound volume for a given sound is the product of the master volume, determined by the command set_master_vol( ), and the sound volume, divided by 127. Similarly, the effective sound volume is combined with the instrument part volume to produce the effective instrument part volume. The pan (e.g. the left and right stereo sound mix) of an individual sound is set with the command md_set_pan( ). The pan may be set over a range of −128 (−64=full left) to +127 (+63=full right), with 0 being the center. The extra range allows the sound's pan setting to override that of the individual instrument parts, which ranges over 64 to +63.

The musical key of a soundfile may be transposed using the command md_set_transpose( ). Either relative (e.g. add the transpose parameter to the current setting) or absolute transpose may be set. The transpose parameter refers to half-step increments, so a parameter of +12 transposes the sound up by one full octave. Note that percussion parts will usually have a "transpose lock" on them so they will continue to play properly when all the pitched parts have been transposed.

The detune of a sound is set using the command md—set detune( ). This allows an out of tune sound to be produced and is useful for certain types of sound effects. The speed of a sound's playback is set over a range of 0 to 255 using the command md_set_speed( ). A speed of 128 is "as composed", with lower values corresponding to slower speeds and higher values corresponding to faster speeds. Note that a speed of 0 will pause the payback but leave the volume turned up.

The command md_jump( ) causes a sound's playback point to jump to a new soundfile destination. The destination of the jump is specified as a chunk, beat, and tick (i.e., in musical time). Notes which are sustaining when the jump occurs will continue to sustain at the soundfile destination for their intended duration. However, notes which are supposed to be sustaining at the destination will not be triggered. In addition, any changes in system configuration, such as instrumentation or volume, will not be interpreted during the jump.

The command md_scan( ) causes a sound's playback point to scan to a new soundfile location. The destination of a scan is specified as a chunk, beat, and tick (i.e., in musical time) similar the md_jump( ) command. Notes which are sustaining when the scan occurs will be stopped immediately. However, notes which are supposed to be sustaining at the destination will be triggered. Unlike jumping, scanning reads through the performance data on its way to the destination, ensuring that MIDI module 110 will be configured as expected.

The command md_set_loop( ) sets the looping parameters for a given sound. The start and end points of the loop are assumed to be in the currently playing chunk and are given as times from the beginning of that chunk. Only one loop at a time per sound is allowed, with a maximum number of repetitions of 65,535 in the preferred embodiment. The command md clear_loop( ) is used to clear the loop parameters of a sound, which prevents further looping.

The command md_set_art_enable( ) enables or disables an individual instrument part of a sound for a given channel. Similarly, the command md_set_part_vol( ) sets the volume of an individual instrument part of a sound for a given channel. These commands give the directing system 111 direct control over individual instrument parts.

The command md_set_hook( ) is used to enable or disable the conditional hook messages that are embedded by the composer in the soundfile. There are six classes of hook messages: jump, transpose, part_enable, part_vol, part_pgmch, and part_transpose. The first two classes apply to all channels of a soundfile, while the last four apply to a single channel which is designated by the message. The hook_id value determines if a hook message encountered in the performance data will be accepted or ignored. All hook messages carry a hook id number. Those with hook_id=0 are always accepted, while all others must match a value set by 111 in order to be accepted.

The command md_fade_vol( ) changes the volume of a sound over time. If the destination volume is 0, the sound will be stopped when volume 0 is reached. If the sound volume is already 0 when the command is called, nothing will happen. Further, if a sound is being faded and a new fade is started for the same sound, the old fade will be stopped and the new fade will begin from the current volume level. Finally, it is possible to do several fades simultaneously to allow cross-fades between groups of sounds.

The final four MIDI commands are processed by command queue 122. The command md_enqueue_trigger( ) enqueues a trigger which specifies a particular sound and marker_id into command queue 122. Each trigger is followed in command queue 122 by a series of commands which are executed when a matching marker message is encountered in the soundfile. Each enqueued command is placed in command queue 122 by the command md enqueue_command( ). The arguments of md_enqueue_command( ) are the 1 to 7 parameters which would be passed to sound_call( ) if the command were being queued directly. To execute an enqueued command, the parameters are extracted from command queue 122 and passed to the command sound_call( ).

To clear command queue 122, the command md_clear_queue( ) is called by directing system 111. This causes command queue 122 and all corresponding parameters to be cleared. Finally, the status of command queue 122 can be read using the command md_query_queue( ). The specific parameters which can be read are: trigger count, trigger sound, and trigger_id.

b. Sound Driver Description

Continuing with the block diagram of sound driver 100 of FIG. 2, file manager module 108 is used for converting a sound number into a corresponding address of a soundfile to allow access to the soundfiles by referring only to their sound numbers. Time control module 106 provides steady interrupts to the soundtype modules at a rate specified in a header file to provide precise time control of the music. Effectively, time control module 106 provides the basic clock rate, from which the beat with which the music is played is derived.

Figure 3:
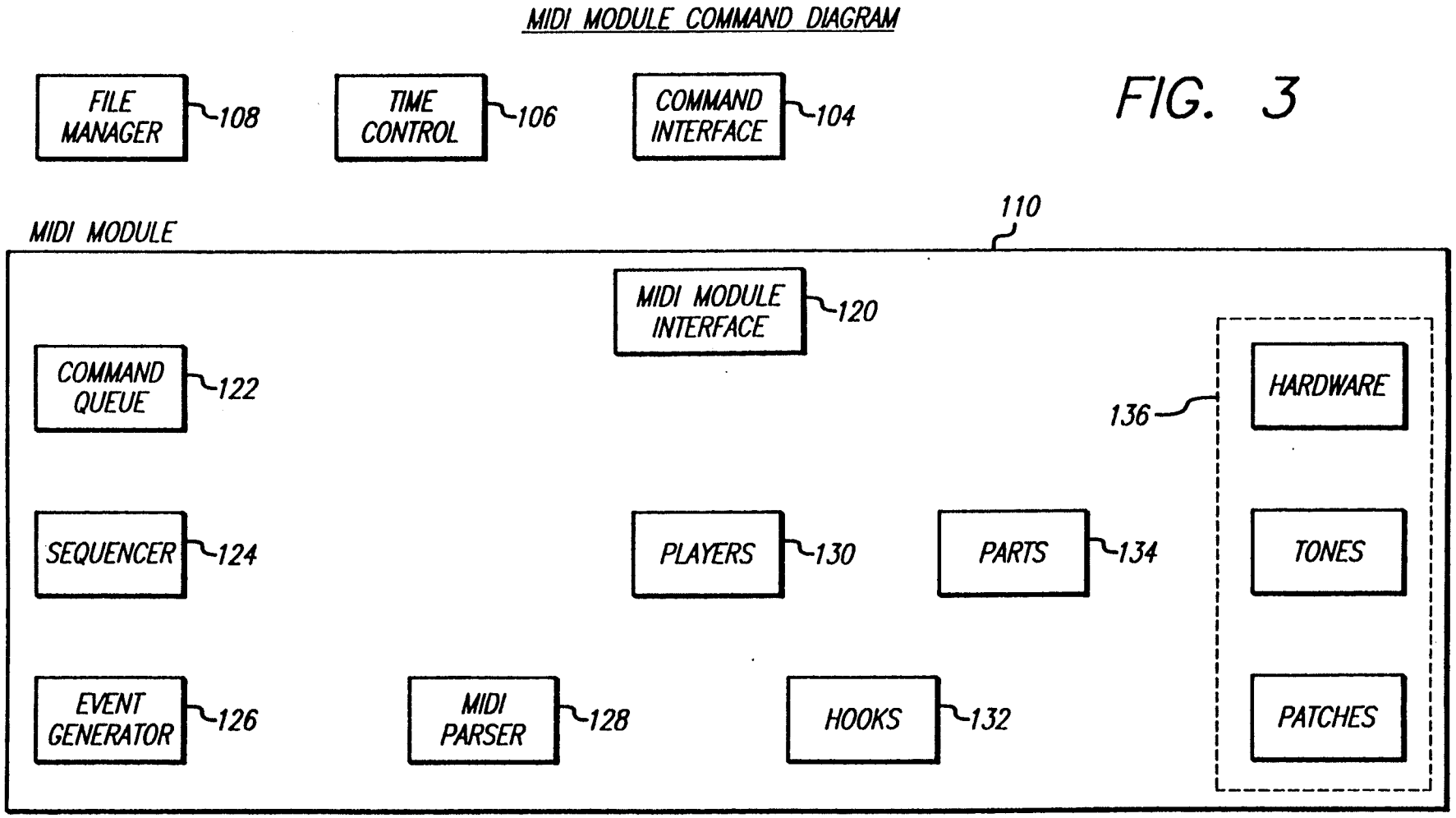
FIG. 3 is a block diagram of the MIDI module (as shown in FIG. 2) for performing operations in accordance with the preferred embodiment of the present invention.

Referring now to FIG. 3, a more detailed description of the MIDI module 110 (FIG. 2) architecture and functions of the preferred embodiment of the invention is now presented. A similar discussion could have been applied to CD and audio modules. In order to implement the commands of Tables 2 and 3, MIDI module 110 consists of the following functional modules: a MIDI module interface 120, a command queue 122, a sequencers module 124, an event generator 126, a MIDI parser 128, a players module 130, a hooks module 132, a parts module 134, and an instrument interface 136. The combination of command queue 122, sequencers module 124, MIDI parser 128 and hooks module 132 provide for the enabling, disabling, and interpretation of the hook and marker messages, thus providing important compositional abilities of the preferred embodiment. The function of each of the functional modules of MIDI module 110, along with their use of the messages and commands of Tables 1 through 3, is now discussed.

MIDI module interface 120 provides the interface between MIDI module 110 and general-purpose modules 104–108. All general and module-specific commands, as well as interrupts from time control 106 to MIDI module 110, pass through module interface 120. Module interface 120 routes each command or interrupt to the appropriate functional module (e.g., modules 122, 124, 130, 132, or 134) for processing.

Command queue 122 is a first-in, first-out (FIFO) buffer which holds one or more triggers, each having a marker_id and sound_number designation, and each followed by zero or more enqueued commands. The enqueued commands are executed when a marker message having a marker_id is encountered in the soundfile being played which matches the sound number and marker_id of the associated enqueued trigger. Only the trigger at the front of command queue 122 is active at any given time. When a match occurs, all subsequent commands in command queue 122 are executed until another trigger message is reached or command queue 122 is empty, whichever occurs first. Any of the general or MIDI commands, (except md_enqueque_command( ) as further discussed below), can be enqueued in command queue 122, and when the enqueued commands are executed the results are exactly as if the commands had come directly from directing system 111. The use of command queue 122 allows commands to be synchronized to the music or delayed until a specific musical event occurs.

For example, when a trigger is first enqueued using the command md_enqueue_trigger( ), it is inactive while its associated commands are enqueued. After the last command has been enqueued, the trigger is activated by calling the command md_enqueue_command( ) with the first parameter set to hexadecimal code FFFF which activates the trigger for comparison with marker messages encountered in the soundfile. After a match for that trigger has occurred and all associated commands have been executed, the next trigger is activated unless command queue 122 is empty or until the associated commands have finished enqueuing.

Sequencers module 124 consists of a given some number of sequencers, each associated with a player in players module 130, to provide a number of player-sequencer pairs. Sequencers module 124 receives interrupts from time control 106 through module interface 120. At each interrupt, sequencers module 124 checks each currently active sequencer. If it is time to interpret the next message in the soundfile, it looks at the soundfile currently pointed to by file manager module 108 and passes the next MIDI message from the soundfile to MIDI parser module 128 for processing. Sequencers module 124 also receives commands from either directing system 111 or command queue module 122 (both through module interface 120), or directly from hooks module 132, players module 130, or MIDI parser 128.

Either directing system 111 or command queue 122 can issue commands to start or stop a sound, to pause or resume playing, to indicate a sound type, or to indicate a sound play status. As previously discussed, each of these functions are activated by a corresponding general command from Table 2, which is passed to MIDI module 110 through module interface 120. In addition, directing system 111 or command queue 122 can issue commands to sequencers module 124 to set the speed of a sound's playback, to jump to a new soundfile location, to scan to a new soundfile location, or to loop between specified start and stop times in a soundfile. These functions are activated by corresponding MIDI module commands from Table 3, which are again passed to MIDI module 110 through module interface 120.

Hooks module 132 can issue the md_jump( ) command to sequencers module 124 causing the sequencer playing the specified sound to jump to a new soundfile location. The new location, or destination, may be specified in musical time or counts from the beginning of the soundfile being played. Although enabled by directing system 111 or command queue 122 at random times, jump hook messages are placed by the composer at points in the sequence which make sense musically.

Hooks module 132 also maintains the data structures for storing and comparing the hook_id values in order to interpret hook messages that are embedded in the soundfile. In addition, hooks module 132 implements the commands received from directing system 111 or command queue 122 to enable or disable one or more hook messages by setting their corresponding hook_id values in the data structure. Accordingly, hooks module 132 receives hook messages containing hook_id values from MIDI parser 128 and compares them with those that have been set by directing system 111. If the hook_id value is zero, the hook message is always accepted. If the hook_id value is not zero but there is a match, the hook message is also accepted.

When a match occurs, hooks module 132 issues a command which depends upon the class of the-matching hook message. If the class is jump, hooks module 132 issues a command to sequencers module 124 to jump to a new soundfile location, as discussed above. If the class is transpose, hooks module 132 issues a command to players module 130 to transpose the soundfile being played. If the class is either part_enable, part_volume, part program change, or part_transpose, hooks module 132 issues a corresponding command to parts module 134. In all cases, whenever a match occurs, after a hook message is implemented, the corresponding hook message is disabled.

When performing a jump, the sequencer does not interpret any configuration commands found in the soundfile on its way to the new location. When scanning, it reads through the soundfile on its way to the new location, thus ensuring that the system will be configured as expected. Jumping is fast and seamless but requires careful planning on the part of the composer to implement, while scanning is slower and thus is not usually used in rhythmically critical situations.

Figure 4A:
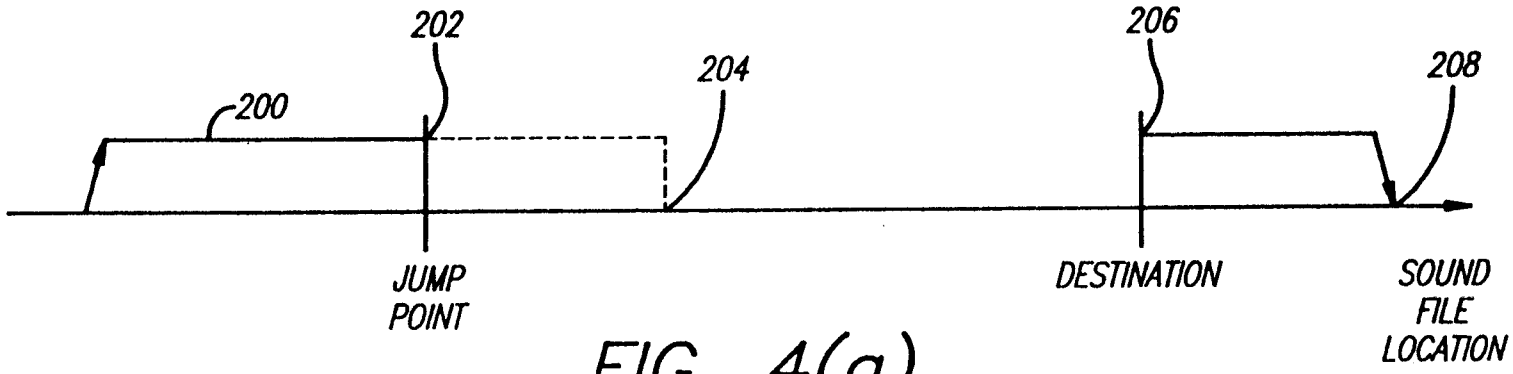
FIG. 4(*a*) is a diagram demonstrating the effect of a jump command on a sustaining note in accordance with the preferred embodiment of the present invention.
Figure 4B:
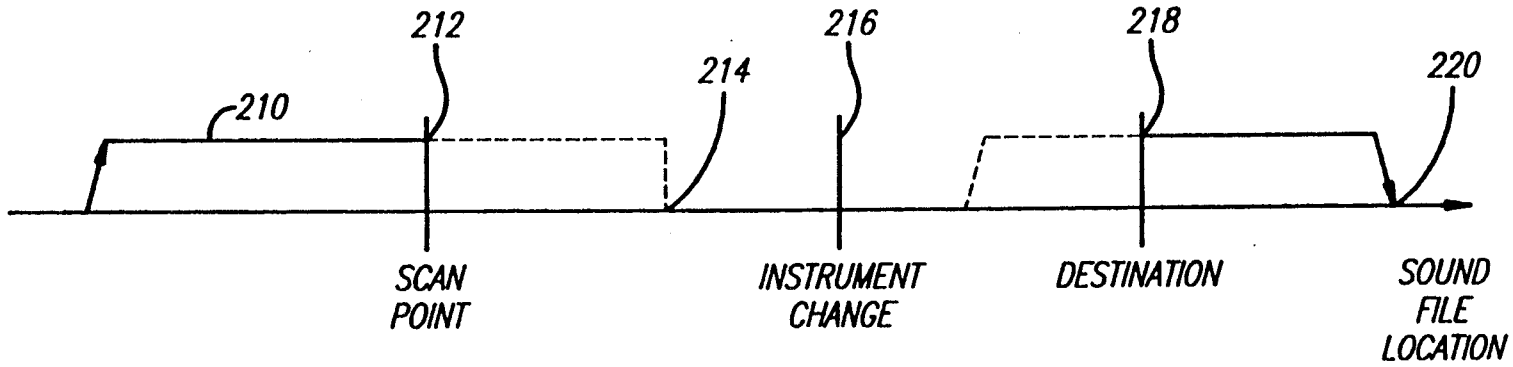
Figure 5A:
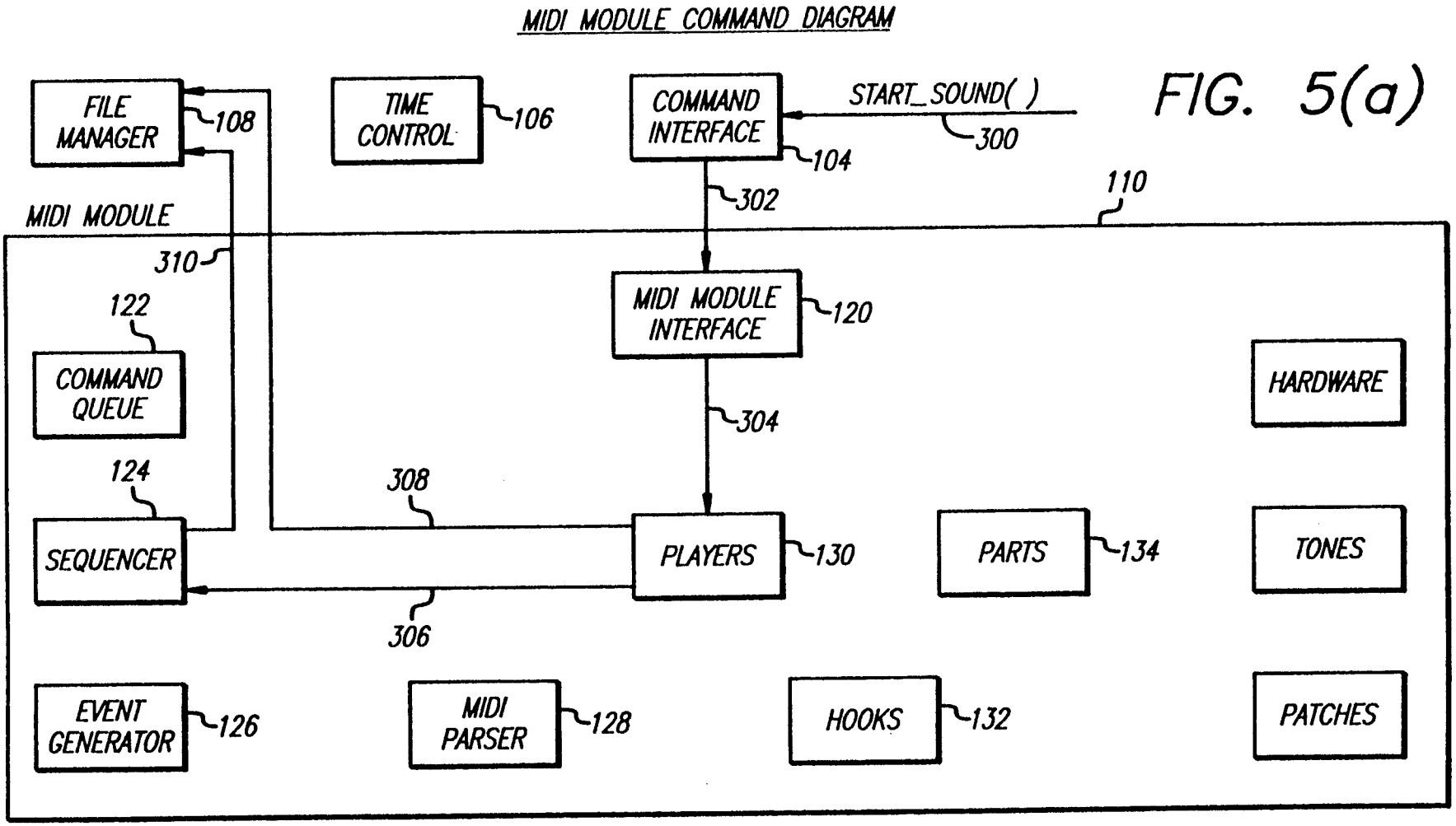
FIGS. 5(*a*)–5(*d*) show the command flow associated with the functional modules of the preferred embodiment of the present invention while playing a standard sound file.
Figure 5B:
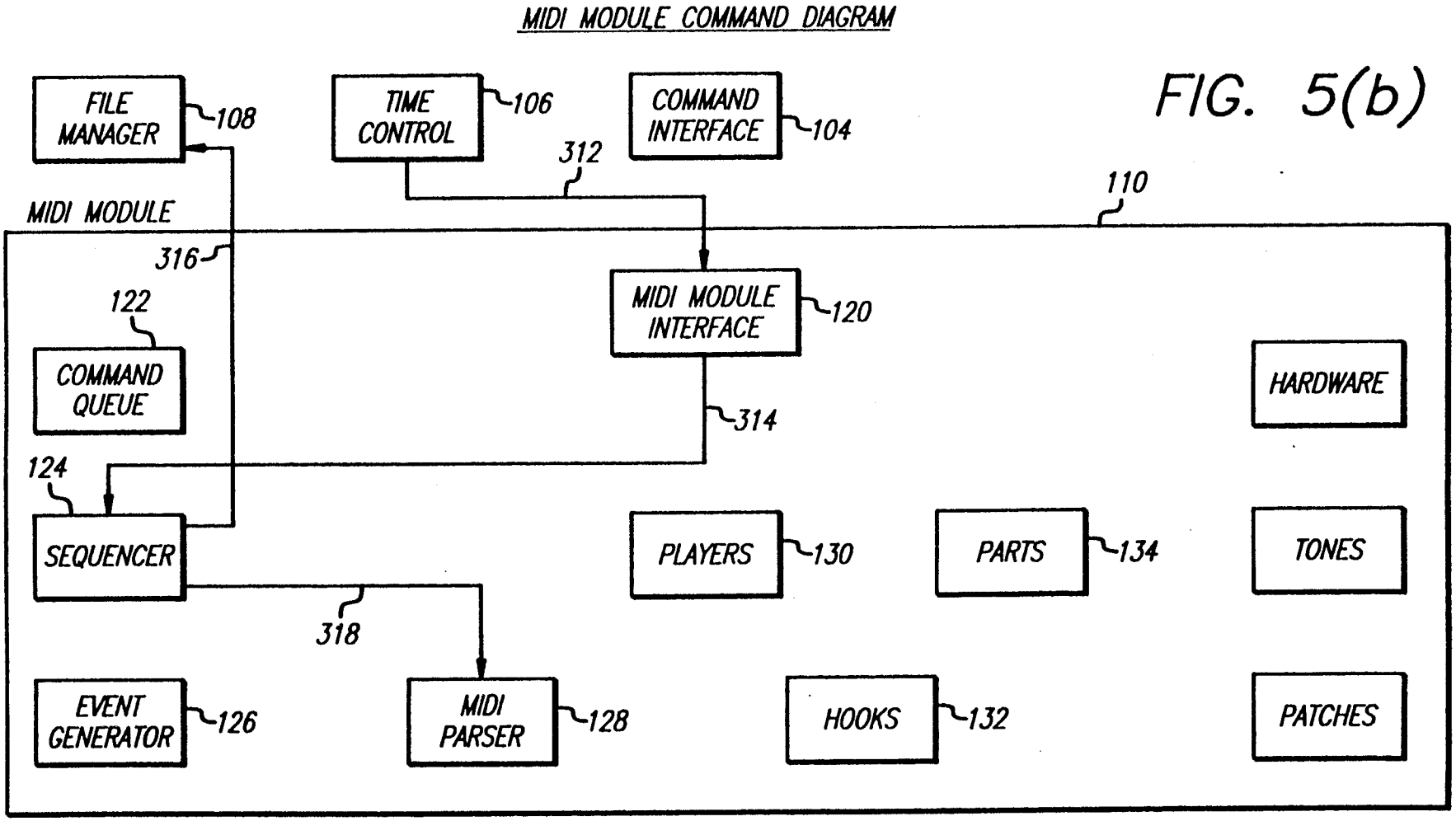
Figure 5C:
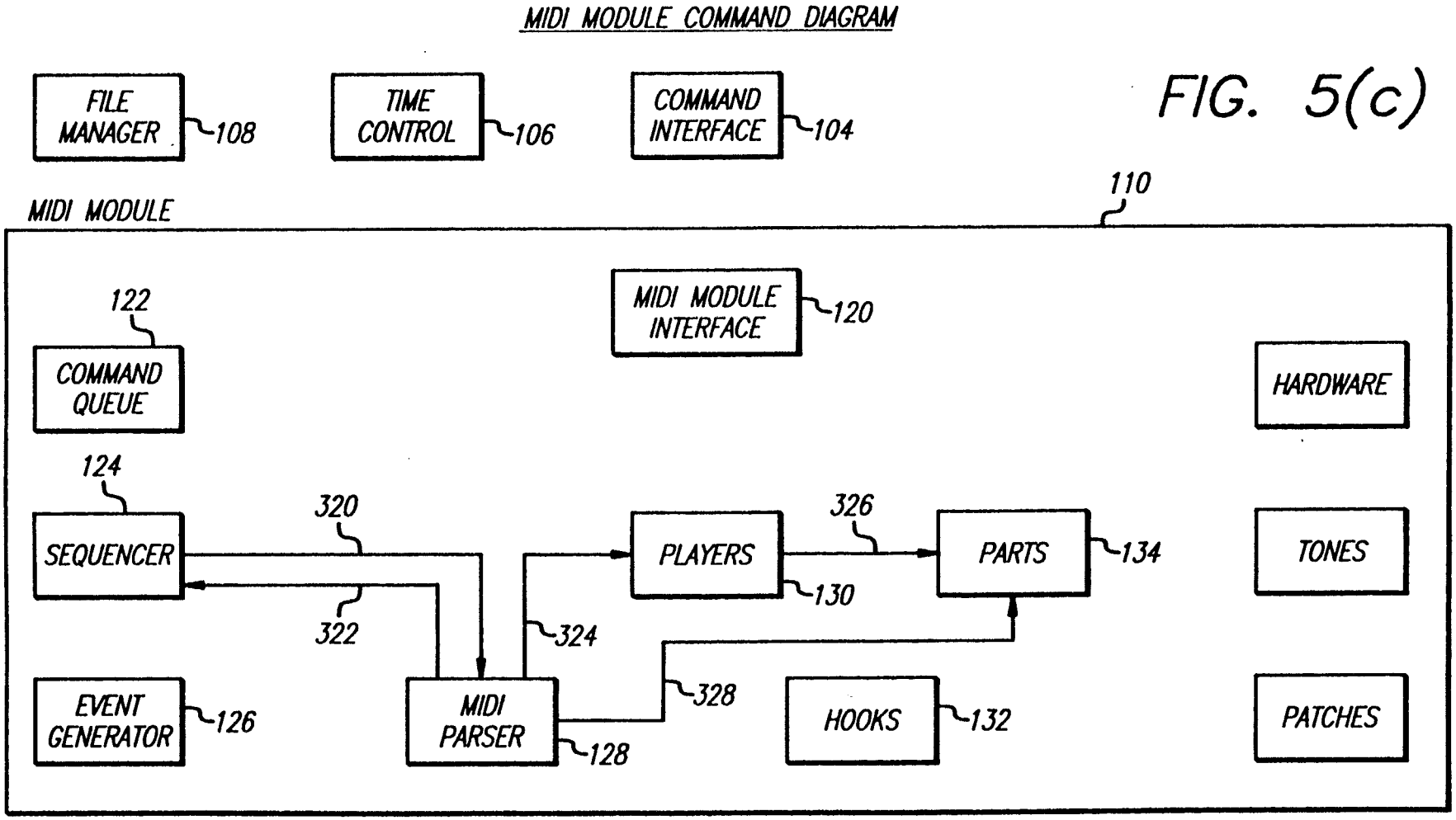
Figure 5D:
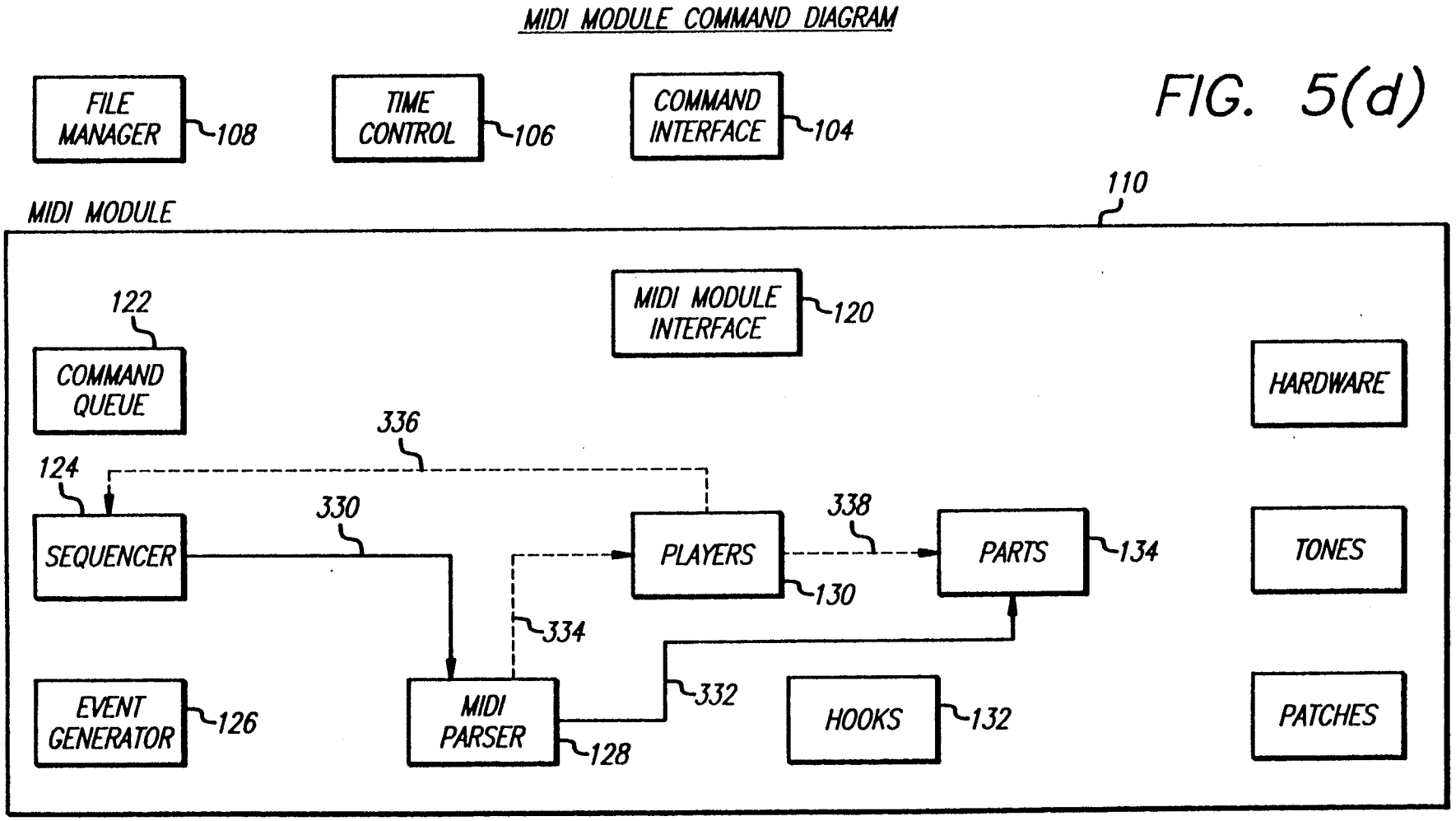

For example, as shown in FIGS. 4(*a*) and 4(*b*), notes that are sustaining at the jump point are continued from the destination point for the remaining tune they would have played had the jump not occurred. Specifically, in FIG. 4(*a*), a sustained note 200 is playing at the time jump point 202 is reached. Had the jump not occurred, note 200 would have sustained until reaching point 204. However, the jump command of the preferred embodiment continues sustaining the note after destination 206 for the time the note would have played, ending the sustained note at point 208.

Similarly, in FIG. 4(*b*) a sustained note 210 is playing at the time scan point 212 is reached. Again, had the scan not occurred, note 210 would have sustained until reaching point 214. In contrast with the jump command, the scan command stops the sustaining note after scan point 212 and starts any note that would have been playing at destination 218, ending the new note at point 220 where it was intended to end. Note also that, in this case an instrument change occurring at point 216 is captured by the scan command and implemented at the destination 218.

MIDI parser 128 interprets all MIDI messages received from sequencers module 124, and uses the results to perform four important functions. First, during the configuration of MIDI module 110, MIDI parser 128 causes parts to be allocated to players module 130, issues instrument selections and sound parameters to parts module 134, and, as previously discussed, issues a command to sequencers module 124 to set the playback tempo. Second, during playback, MIDI parser 128 passes note on, note off, pitch bend, or controller channel voice messages to parts module 134. Third, if any hook or marker messages are encountered during playback, MIDI parser 128 passes the corresponding marker_id or hook_id values to command queue 122 or hooks module 132, respectively. Fourth, parser 128 issues a command to players module 130 to stop the sound playback when the end of the soundfile is reached. Recall that Table 1 provides a complete list of MIDI messages passed by sequencers module 124 to MIDI parser 128.

MIDI parser 128 can also issue a message to sequencers module 124 to set or change the tempo of a currently playing soundfile. Usually, one of the first messages encountered by MIDI parser 128 during playback of a soundfile is a meta event which sets the music tempo. The tempo can also be dynamically changed using meta event messages placed throughout the soundfile.

Players module 130 arbitrates which player-sequencer pair is playing a particular soundfile and maintains a player-sequencer data structure for each player-sequencer pair. The player-sequencer pairs are each analogous to a hardware tape player and are used to play a soundfile. Players module 130 also stores other performance parameters such as priority, volume, pan, transpose, and detune, and implements commands to change the playback parameters of specified sounds. Finally, players module 130 can set the playback speed of a sequencer.

Under the command of directing system 111 or command queue, players module 130 issues commands to sequencer module 124 to start or stop playing a soundfile.

Referring again to FIG. 3, event generator 126 receives a single md_fade_vol( ) command from directing system 111 or command queue 122, and generates a series of commands to change the volume of a specified sound gradually over time. These commands are sent to players module 130, which is responsible for maintaining the sound's setting. If the destination volume is set to zero, the sound will be stopped when its volume reaches zero. Additionally, if a sound is being faded and a new volume fade command is received for the same sound, the old fade will be stopped and the new fade started at the current volume level. Finally, it is possible to perform several volume fades simultaneously to allow crossfades between designated groups of sounds.

Parts module 134 maintains data structures containing parameter settings for each instrument part, and maintains the associations between parts and players in the form of linked lists. Incoming channelized performance data from MIDI parser 128 is received by instrument parts with corresponding channels, which issues performance commands to a synthesizer driver 136. Synthesizer driver 136 consists of hardware-specific software which configures and maintains the interface between MIDI module 110 and the synthesizer hardware that produces the actual sound. This module is specific to the actual synthesizer being driven.

c. Sound Driver Operation

The basic operation of apparatus 100 is now illustrated with reference to FIGS. 5-10. The specific functions illustrated include linear playback of a standard MIDIfile, playback of a soundfile containing an enabled hook message, and playback of a soundfile containing an enabled marker message. Also illustrated are the implementation of a jump command and the issuing of a part enable command.

Referring to FIGS. 5(*a*)-5(*d*), the linear playback of a standard MIDIfile is reviewed. In FIG. 5(*a*) at step 300 directing system 111 issues the command start_sound( ) to command interface 104, which, in turn, passes the command to MIDI module interface 120 at step 302. At step 304, MIDI module interface 120 instructs players module 130 to initiate the playback process. At step 306, players module 130 allocates a player-sequencer pair and at step 308 retrieves default performance parameters from the soundfile which is to be played. At step 310, sequencers module 124 then accesses file manager 108 to determine how long to wait before retrieving the first MIDI message from the MIDIfile. MIDI module 110 then waits for an interrupt from time control 106.

Continuing with FIG. 5(*b*), the actions which occur each time an interrupt is received from time control 106 are illustrated. Each interrupt is generated by time control 106 and at step 312 are passed to MIDI module interface 120 which then passes them to sequencer module 124 at step 314. If it is time to process the next message, sequencer module 124 then retrieves the next message from the MIDIfile at step 316 and passes it to MIDI parser 128.

FIG. 5(*c*) shows the configuration steps which occur in response to a MIDI message. At step 320 sequencers module 124 passes the message to MIDI parser 128 which parses the message and performs one of several actions, depending on the specific message received. Examples of actions include setting the tempo (step 322), allocating instrument parts (steps 324 and 326), or selecting instruments and channels (step 328). Referring to FIG. 5(*d*), the playback of the sequence continues with sequencers module 124 passing messages, such as note_on or note_off messages to MIDI parser 128 at step 330 which, at step 332, passes them to parts module 134 for playing. When an end_of_track message is received, MIDI parser 128 sends a command at step 334 to players module 130 which sends a command at step 336 to sequencers module 124 and at step 338 to players module 134 to stop the playback.

Figure 6A:
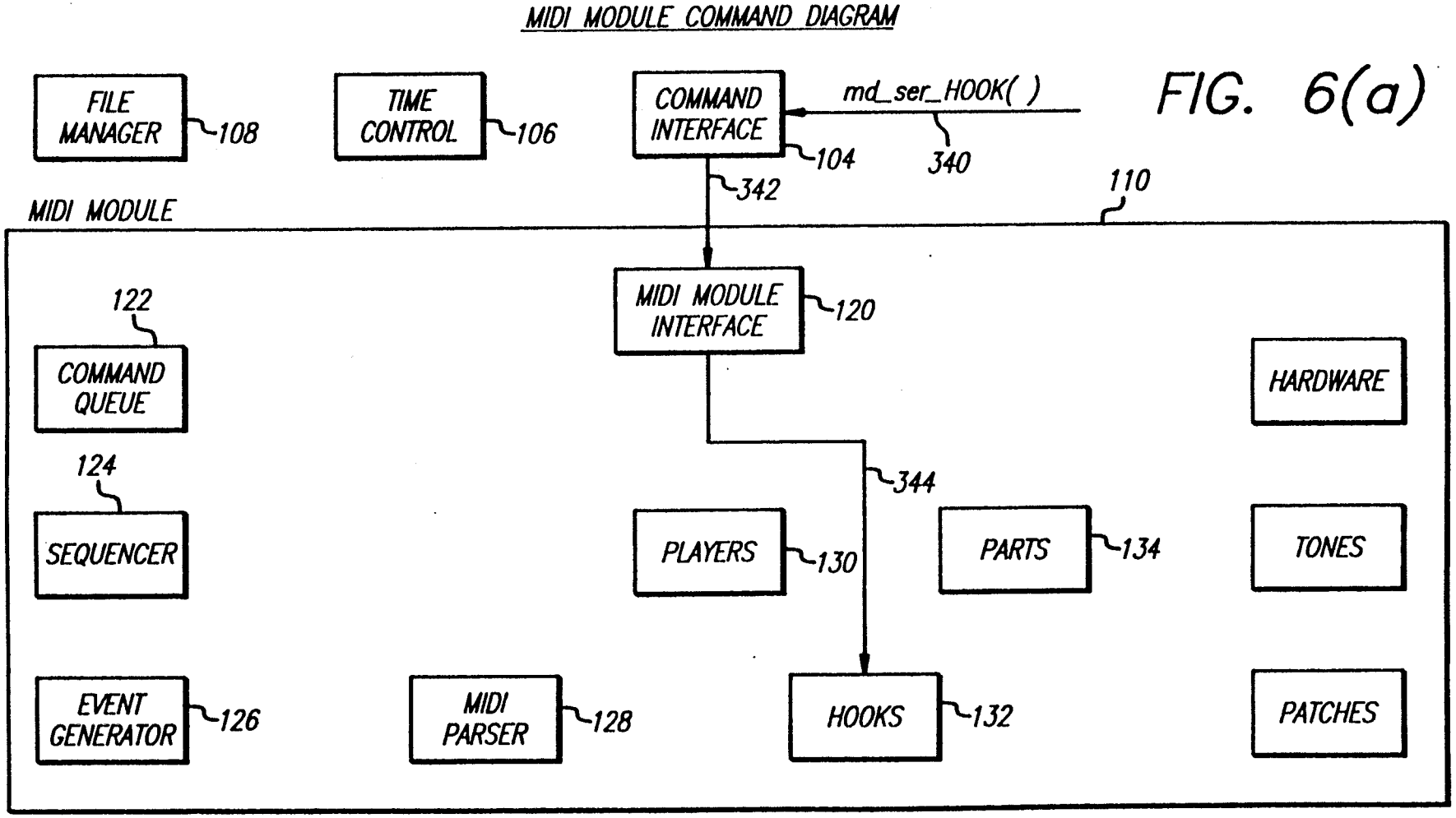
FIGS. 6(*a*)–6(*b*) show the command flow associated with the functional modules of the preferred embodiment of the present invention while responding to a hook message.
Figure 6B:
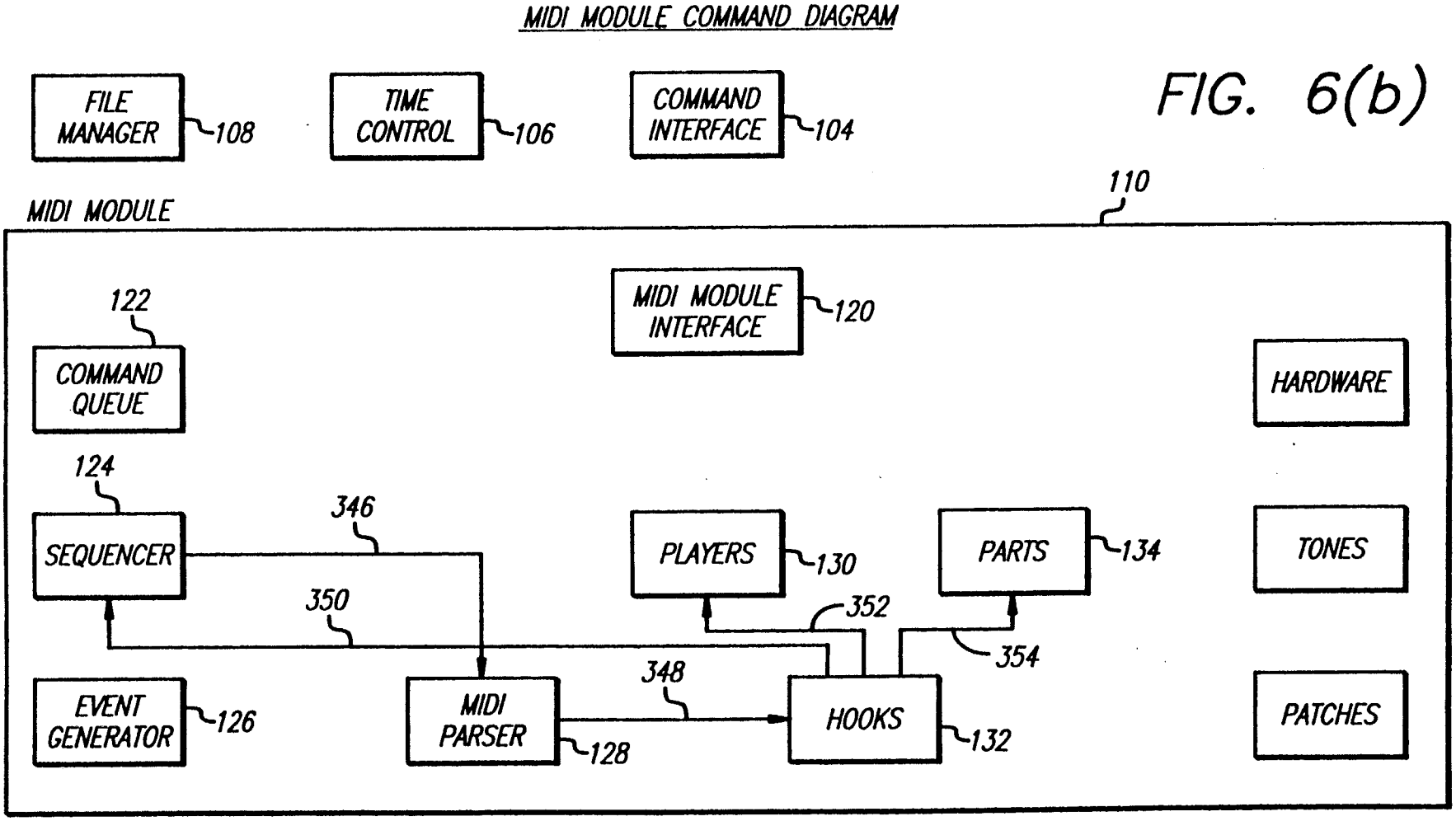

Referring now to FIGS. 6(*a*)-6(*b*), the playback of a soundfile containing a hook message is now discussed. The same starting, interrupt, and configuration steps occur here as in the previous example. However, as shown in FIG. 6(*a*), before or during playback directing system 111 enables one of the hook messages at step 340 by sending the command md_set_hook( ) to command module 104 which, at step 342, sends the command to module interface 120. At step 344, module interface 120 sends a command to hooks module 132. Referring to FIG. 6(*b*), during playback at step 346, each hook message is passed by sequencers module 124 to MIDI parser 128, which passes the hook message to hooks module 132 at step 348 for hook_id comparison. If there is a match an appropriate command is sent to either sequencers module 124 (step 350), players module 130 (step 352), or parts module 134 (step 354).

Figure 7A:
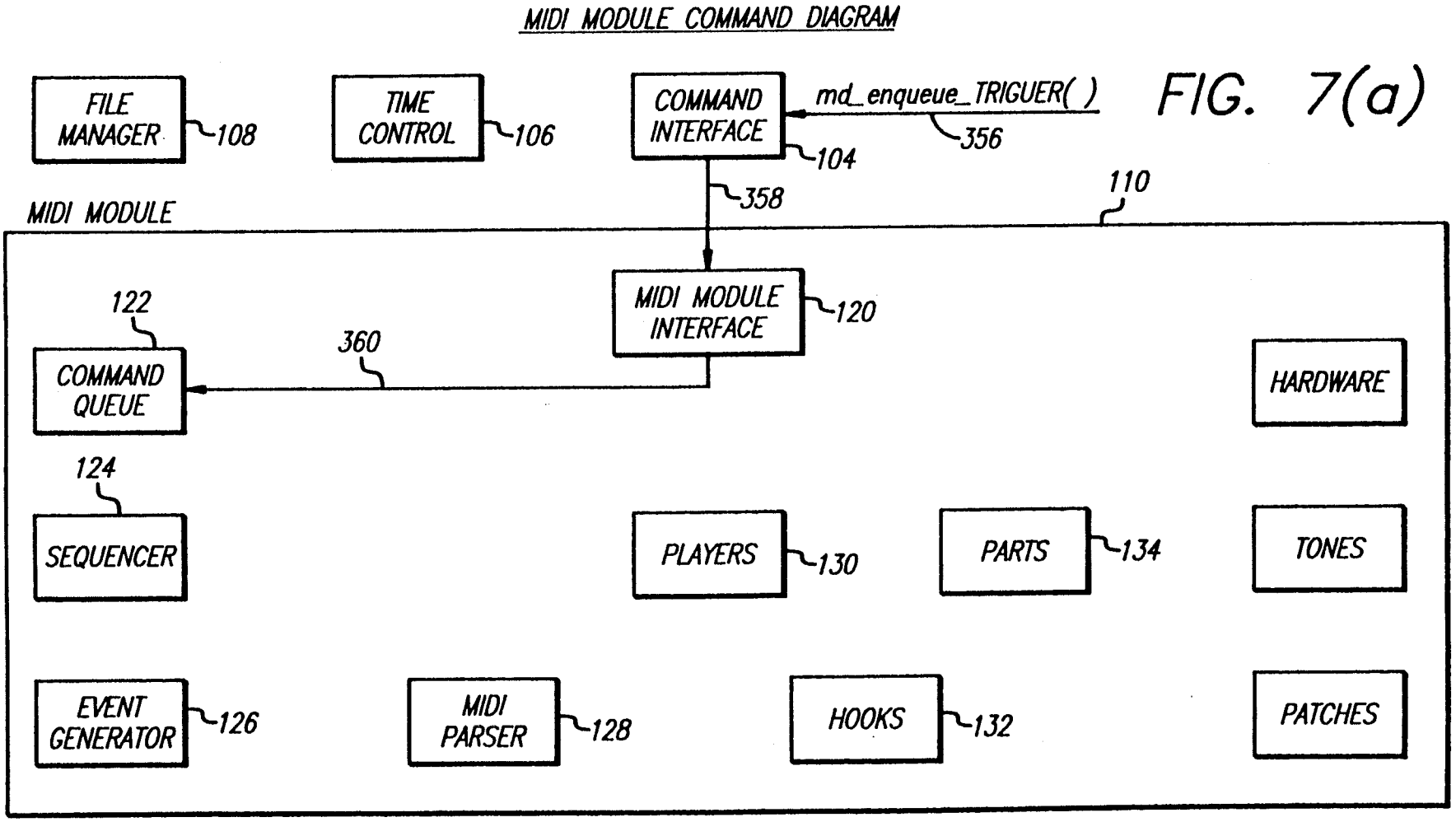
FIGS. 7(*a*)–7(*c*) show the command flow associated with the functional modules preferred embodiment of the present invention while responding to a marker message.
Figure 7B:
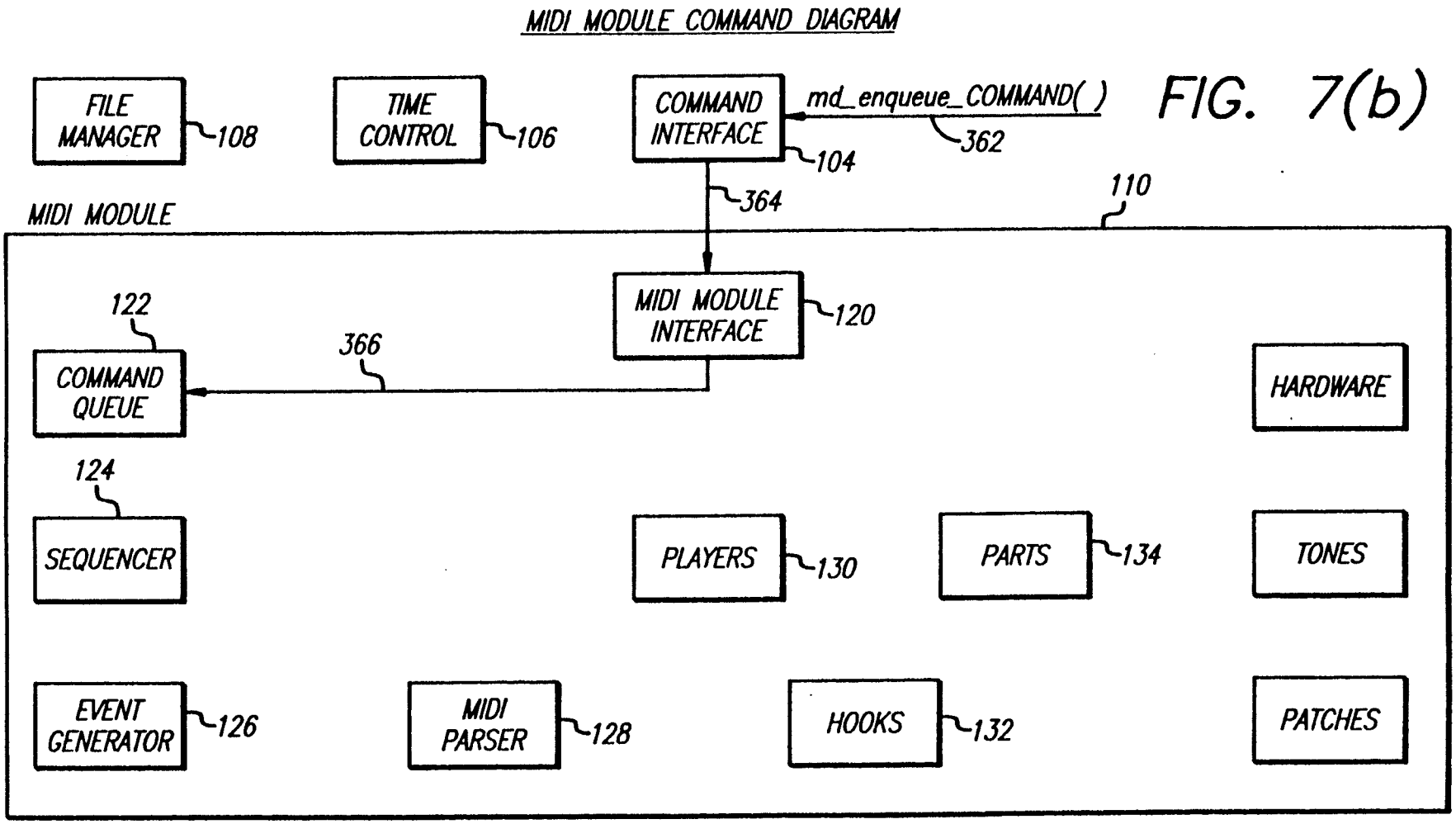
Figure 7C:
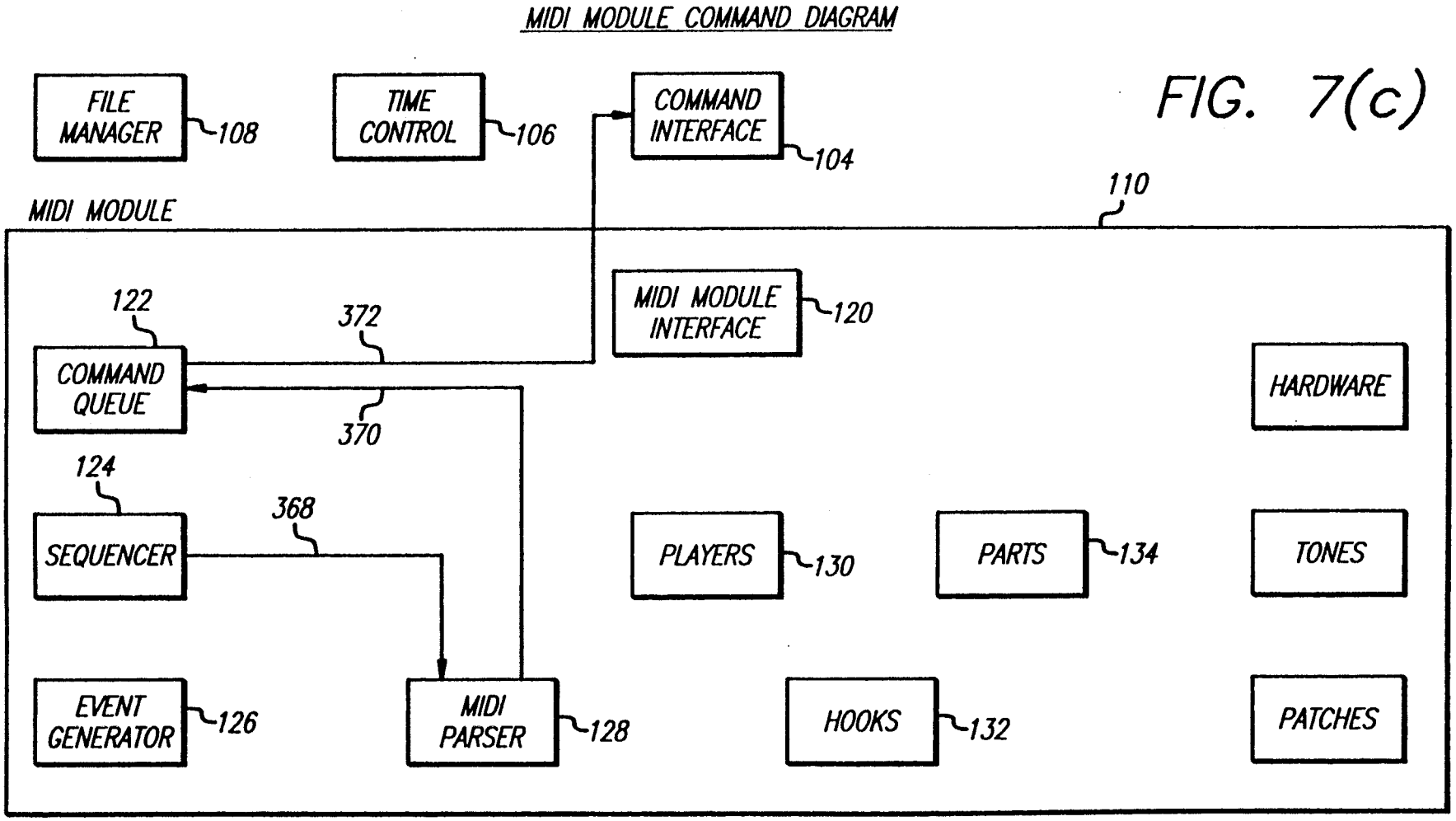

The processing of marker messages is similar to that of hook messages. As shown in FIG. 7(*a*), before or during playback directing system 111 enqueues a trigger by sending at step 356 an md_enqueue_trigger( ) command to command interface 104 which sends the command to module interface 120 at step 358. Then, at step 360, module interface 120 sends a command to command queue 122. Directing system 111 then enqueues one or more commands by sending at step 362 one or more md_enqueue_command( ) commands to command interface 104 which sends each command to module interface 120 at step 364. At step 366, module interface 120 sends a command to command queue 122, as shown in FIG. 7(*b*).

Referring now to FIG. 7(*c*), during playback at step 368 sequencers module 124 sends each marker message to MIDI parser 128, and the marker_id and sound number of each marker message that is encountered is passed by MIDI parser 128 to command queue 122 at step 370 for comparison with the enqueued trigger. If there is a match, at step 372 the enqueued commands are sent to command interface 104 for processing, exactly as if they had been issued by directing system 111.

Figure 8:
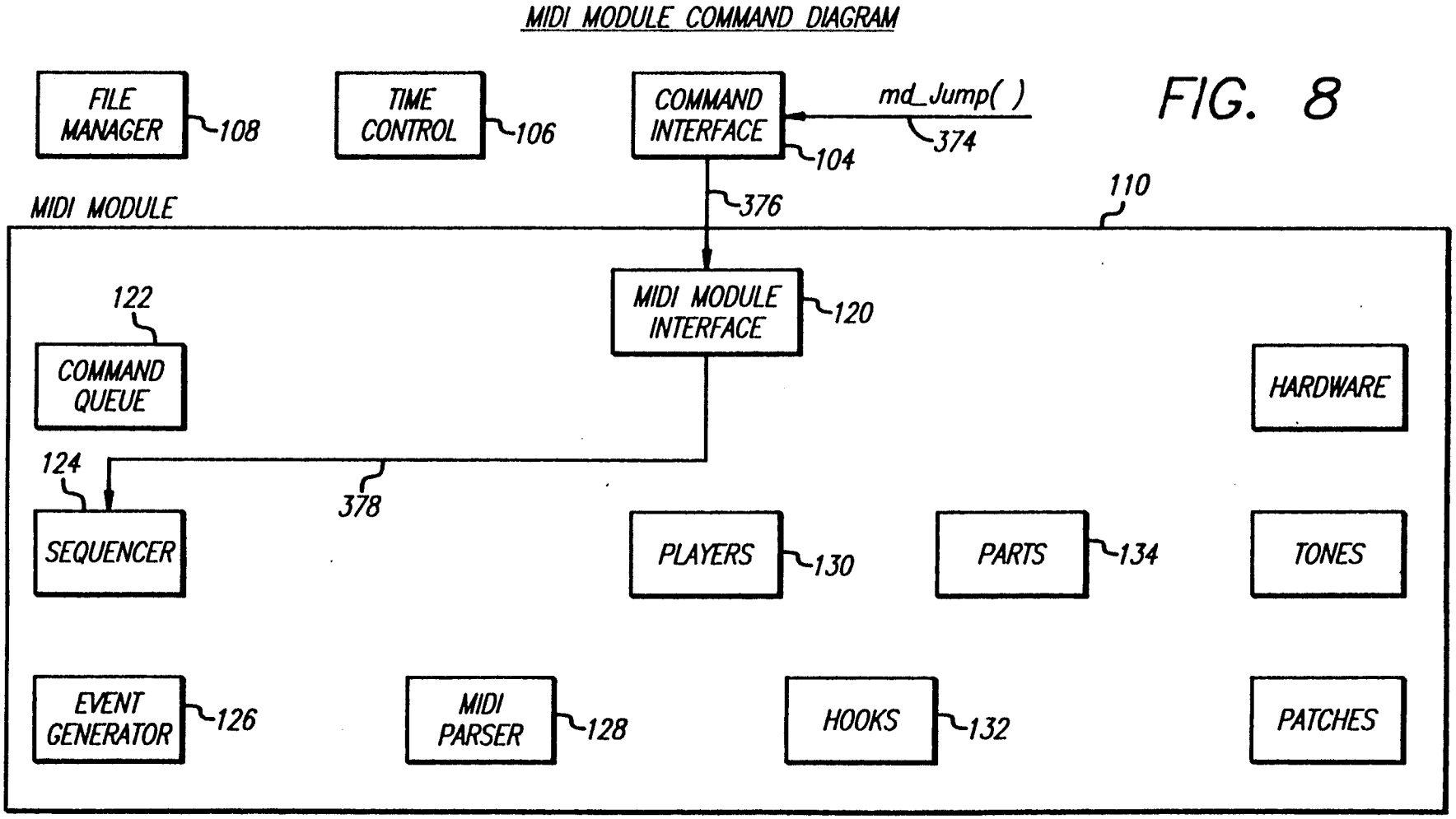
FIG. 8 shows the command flow associated with the functional modules preferred embodiment of the present invention when a jump command is issued by the directing system.

FIG. 8 shows the use of an md_jump( ) command by directing system 111. At step 374 the command is passed to command interface 104, which passes the command to module interface 120 at step 376. At step 378 module interface 120 passes the md_jump( ) command directly to sequencers module 124 and, as opposed to jumps derived from hook messages, the jump occurs immediately. This command gives directing system Ill direct control over the playback of a soundfile.

Figure 9:
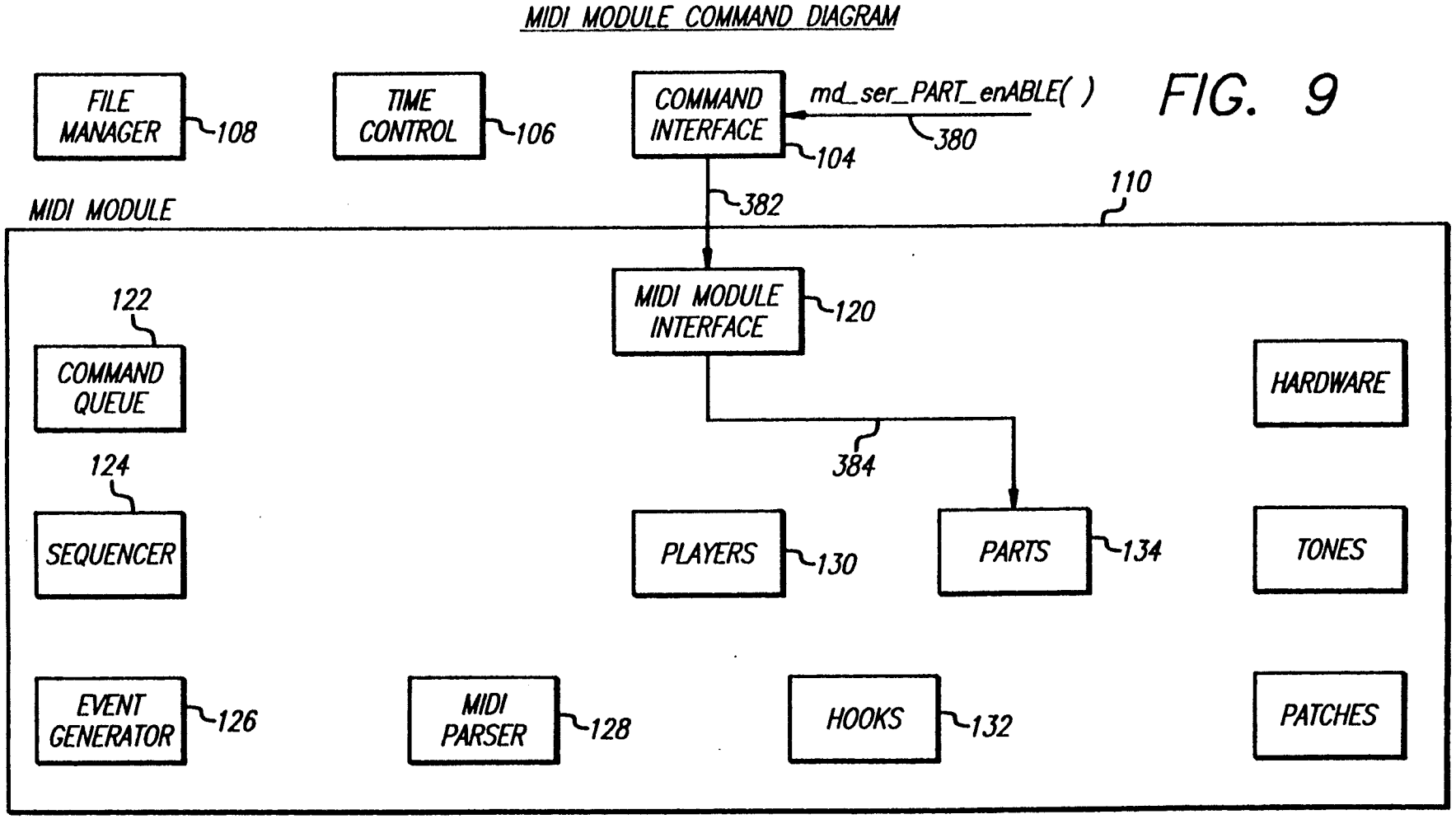
FIG. 9 shows the command flow associated with the functional modules preferred embodiment of the present invention when a part enable command is issued by the directing system.

FIG. 9 shows the use of an md_set_part_enable( ) command by directing system 111. At step 380 the command is passed to command interface 104 which, at step 382, passes the command to module interface 120, which passes the command directly to parts module 134 to enable or disable the instrument part associated with the specified MIDI channel. Only the note playing is disabled; all other MIDI-messages continue to be executed. This command also gives directing system 111 direct control over the playback of a soundfile.

Figure 10:
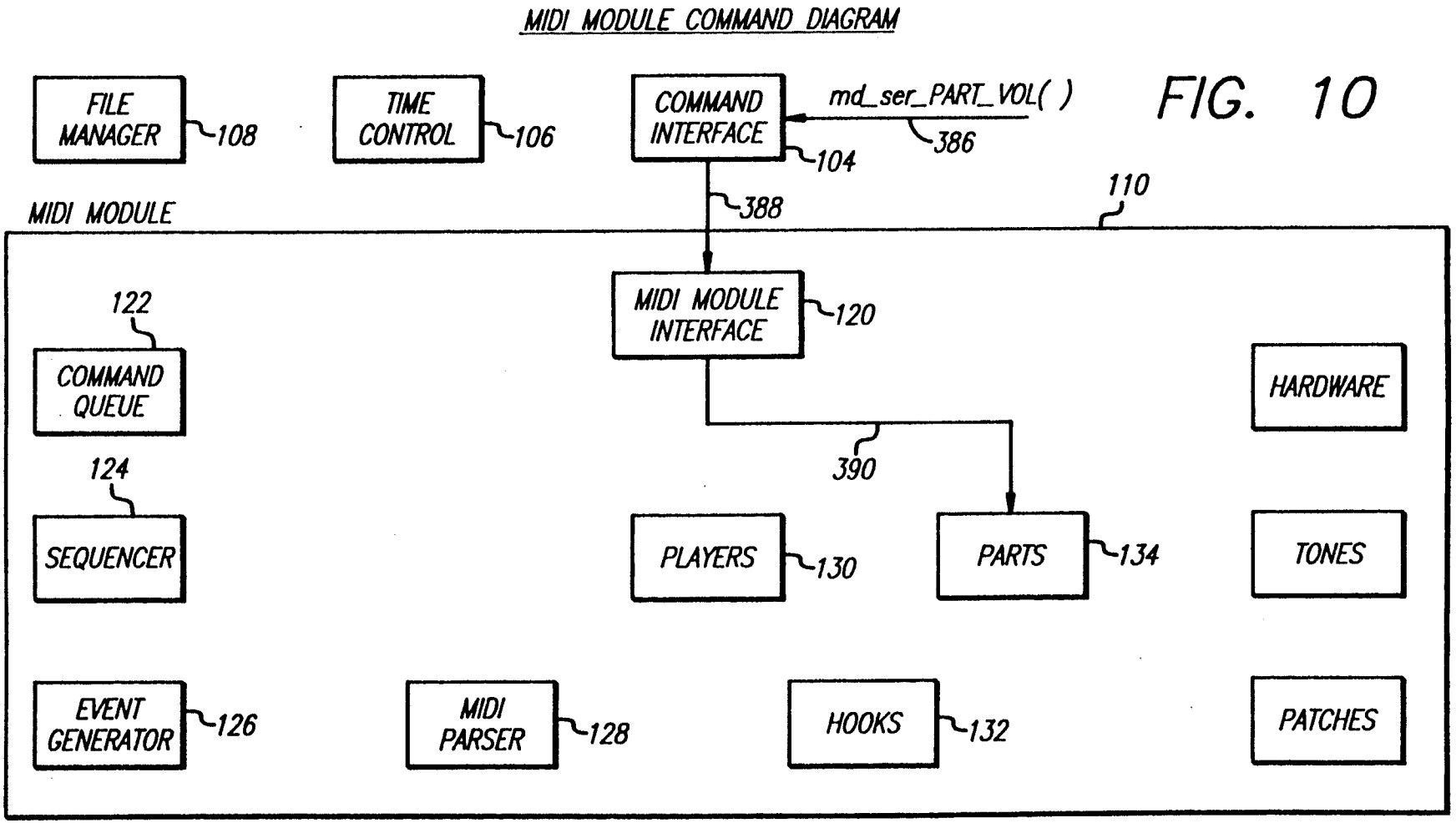
FIG. 10 shows the command flow associated with the functional modules preferred embodiment of the present invention when a part volume command is issued by the directing system.

FIG. 10 shows the use of an md_set_part_vol( ) command by directing system ill. Again, at step 386 the command is passed to command interface 104 which, at step 388, passes the command to module interface 120 at step 390. Module interface 120 passes the command to parts module 134, which sets the volume of an individual part of a sound. Once again, this command gives directing system Ill direct control over the playback of a soundfile.

5. Composition Database Formation and Utilization a. Composing and Conditionalizing MIDI Sequences The method for forming the composition database 101 is comprised of the following steps. A human composer first composes one or more sequences, using standard MIDI hardware and software. The composer composes the sequences to be musically appropriate for the demands of the particular application of the invention. For example, in the case of a computer/video game, the composer would structure the sequences according the plot and action segments of the game.

The composer then begins the process of conditionalizing the raw musical material as represented by the sequences. Conditionalizing consists of determining aesthetically appropriate ways for the music to react to actions of the directing system 111. Reacting provisions come in two forms, control instructions for directing system 111 and modifications to composition database 101.

In their simplest form, control instructions simply tell the directing system 111 how to issue the appropriate direct commands to the sound driver. Although most direct commands refer to, and must be coordinated with, composition database 101, no special modification of composition database 101 is required. For example of this is a command which simply starts a particular piece of music needs only to specify where in composition database 101 to find the piece, and perhaps the circumstances under which it should be started and stopped.

A more complex example in the same category is that of a direct command requiring more detailed knowledge of composition database 101. For example, a piece of music might need to have particular instrument parts enabled or disabled. In such a case, the control instructions would need to specify which instrument parts to turn on or off, and perhaps under what circumstances to do so.

A further complexity arises when composition database 101 must be altered in some way in order to accommodate the operation of a direct command. In the previous example, the performance data of the various conditionally enabled instrument parts may need to be adjusted or completely re-composed in order to account for the aesthetic demands of different combinations of instrument parts. Nevertheless, the control instructions of the previous example would be sufficient.

Even more complexity arises when the directing system 111 initiates changes in the music by setting conditions in the sound driver rather than by commanding it directly. Recall that the sound driver evaluates these conditions at decision points located within the performance data, and then takes appropriate action. Also recall that there are two kind of messages which may be placed at decision points: hook messages and marker messages.

To implement a hook message, the composer first determines where the decision point should be located, and the conditional action that might take place there. The composer then creates a hook message specifying a hook_id and the chosen conditional action, and inserts it into the performance data at the decision point. Next, the composer creates control instructions specifying the hook_id, hook_class and MIDI channel (when applicable), as well as the circumstances under which the hook is to be activated.

To implement a marker message, the composer first determines where the decision point should be located, and the conditional actions that might take place there. The composer then creates a marker message specifying a marker_id and inserts it into the performance data at the decision point. Next, the composer creates control instructions specifying the marker_id, the chosen conditional actions, and the circumstances under which the marker is to be activated.

It should be noted that the control instructions provided to directing system 111 may include provisions for randomizing the commands used to control the sound driver.

The process of conditionalizing composition database 101 is used to achieve an interlinked set of sequences, which branch, coverage, and loop in any number of ways. To illustrate this goal, consider the following example in which a composition database is created and conditionalized for use with an action scene of a computer/video game.

The composer first composes one or more "main" sequences, which provide the primary background music and are intended to be started at the beginning of a corresponding action scene and looped until the end of the scene. Some instrument parts of the main sequence may be designed to play continuously, while others are designed to be conditionally enabled or disabled depending upon specific events occurring in the scene. Accordingly, during conditionalization of the composition database the composer can insert hook messages between each musical phrase of each instrument part, thus allowing the system to transpose an instrument part, change the volume or instrument selection of an instrument part, or turn an instrument part on or off only if the proper conditions occur. In addition, the composer can insert one or more jump hook messages at musically appropriate points in the main sequence. When enabled by the system, the jump hook messages allow the music to conditionally jump to another sequence at the appropriate time, again depending upon specific events occurring in the scene.

The composer may also compose one or more "transition" sequences, which provide musically graceful transitions from a source sequence to a destination sequence. For example, a source sequence may be one of the looped main sequences and a destination sequence may be a different main sequence or a "termination"

sequence. Accordingly, the composer designs a "transition sequence" connecting each decision point of the source sequence containing a jump hook message with its corresponding destination sequence. If one of the jump hook messages is enabled, a jump to the destination sequence occurs at the decision point of the source sequence. Further, each instrument part of the transition sequence can be conditionally controlled using hook messages inserted between the musical phrases of the transition sequence. In addition, the composer can also insert one or more marker messages at the end of each transition sequence to signal the entertainment system to start playing the destination sequence.

The composer also composes a termination sequence which corresponds to the end of a major scene or action of the game. Again, each instrument part of the termination sequence can be conditionally controlled using hook messages inserted between the termination sequences' musical phrases. In addition, the composer can insert a marker message within transition sequence to signal the entertainment system to start playing another main sequence.

Note that these steps are not necessarily accomplished in the order given, but may be modified as dictated by the aesthetic requirements of the composing process. The end result is an interwoven set of sequences which can be conditionally traversed by apparatus 100.

b. Example: Assembly of a Sound Track

Figure 11:
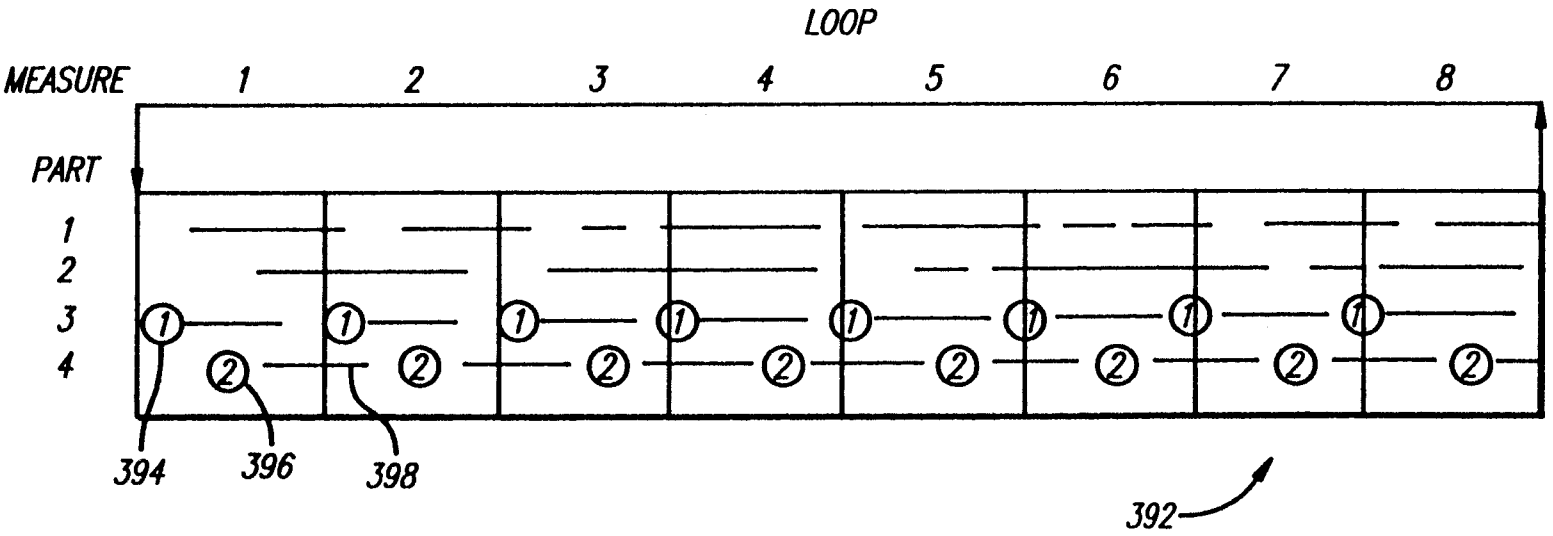
FIG. 11 is a diagram of a continuously looped music sequence that includes hook messages in accordance with the preferred embodiment of the present invention.

Referring to FIG. 11, the previously discussed fight scene of a computer/video game running on a computer entertainment system is now considered in more detail. FIG. 11 shows eight measures of a continuously looped music sequence 392 composed and conditionalized as discussed above and consisting of four instrument parts. Parts 1 and 2 are played during the entire fight scene, while part 3 is played only when a specific fighter is winning and part 4 is played only when that fighter is losing. Accordingly, parts 1 and 2 contain no hook messages, while parts 3 and 4 contain enable hook messages 394 and 396 between each musical phrase 398. Musical phrases 398 are sequences of notes which must be played without interruption in order to preserve the natural flow and momentum of the music. All of the hook messages for enabling a part contain hook_id=1, while those disabling a part contain hook_id=2.

At the start of the fight scene, music sequence 392 is started with parts 1 and 2 turned on and parts 3 and 4 turned off. If the specific fighter begins to lose, computer entertainment system calls the command md_set_hook( ) with parameters hook_id=1 and chan=3. This enables each part enable hook message 394 which causes part 3 to begin playing at the next melodically appropriate point (i.e. between musical phrases 398). Later, if the specific fighter begins to recover, computer entertainment system calls the md_set_hook( ) with parameters hook_id=2 and chan=3. This step disables each part enable hook message 394 which now causes part 3 to stop playing at the next melodically appropriate point. Similarly, if the specific fighter now begins to win, the entertainment system calls the command md_set_hook( ) with parameters hook_id=1 and chan=4. This step enables the enable hook message 396 which causes part 4 to begin playing at the next melodically appropriate point. The process of enabling and disabling part enable hook messages 394 and 396 continues until one of the fighters loses the fight.

Figure 12:
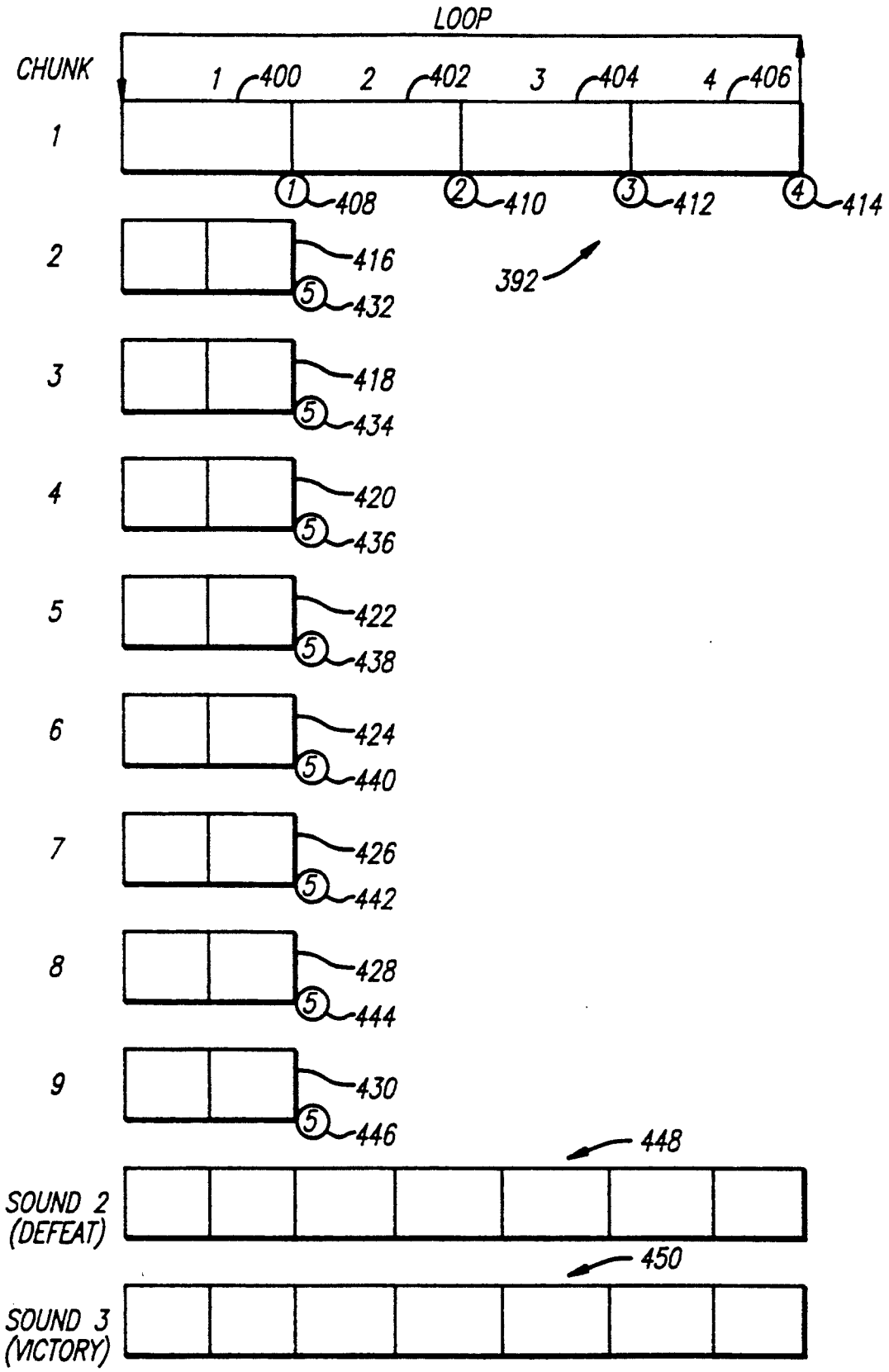
FIG. 12 diagrams a process for terminating the continuously looped music sequence in one of two ways in accordance with the present invention.

Referring now to FIG. 12, the transition to victory music 450 or defeat music 448 is now discussed. Chunk 1 of FIG. 12 is four measures 400–406 of continuously looped music sequence 392 of FIG. 11. Two jump hook messages 408–414 are placed at the end of each of the measures 400–406 of music sequence 392, one for transitioning to defeat music 448 and the other for transitioning to victory music 450. Jump hook messages 408–414 apply to all four parts of the sequence 392. Chunks 2 through 9 are transition sequences 416–430 which provide musically graceful transitions from the end of their corresponding measure 400–406 of sequence 392 to the corresponding victory music 450 or defeat music 448. Marker messages 432–446 with marker_id=1 is placed at the end of each of transition sequences 416–430.

Continuing with FIG. 12, when a fighter wins or loses, corresponding jump hook message 408–414 at the end of the next measures 400–406 of continuously looped sequence 392 is enabled by the entertainment system using md_set_hook( ) with hook_id=1 (for defeat) or hook_id=2 (for victory). In addition, a trigger is enqueued in command queue 122 by computer entertainment system using md_enqueue_trigger( ) with marker_id=1, along with a command to start either defeat music 448 or victory music 450. If the specific fighter has lost, a command to start sound 2 (defeat music) is enqueued with the trigger, while if the fighter has won, a command to start sound 3 (victory music) is enqueued with the trigger. When the continuously looped music sequence 392 reaches the measures 400–406 having the enabled jump hook messages 408–414, the music immediately jumps to the appropriate transition sequence 416–430. At the end of the transition sequence, the marker is encountered and either victory music 448 or defeat music 450 is played.

While the present invention has been described in an exemplary and preferred embodiment, it is not limited thereto. Those skilled in the art wi-11 recognize that a number of additional modifications and improvements can be made to the invention without departing from its essential spirit and scope. Accordingly, the scope of the present invention should only be limited by the following claims.

What is claimed is:

1. An apparatus for dynamically composing a musical sound track, said apparatus comprising:

a composition database comprising musical performance data corresponding to one or more musical sequences, said composition database further including one or more conditional messages, said conditional messages integrated with said musical performance data forming a decision tree;

means for providing real-time;

means for evaluating said decision tree depending on said real-time input; and means for forming said musical sound track.

2. The apparatus of claim 1 wherein said decision tree defines a plurality of alternative paths connecting one or more of said musical sequences, and said means for evaluating include means for selecting one or more of said paths depending on said real-time input.

3. The apparatus of claim 2 wherein said one or more musical sequences include one or more transitional sequences, each of said one or more transitional sequences for providing a musical transition from a source sequence to either a destination sequence or a musical termination.

4. The apparatus of claim 1 wherein said one or more conditional messages include one or more messages for turning on or turning off one or more instrument parts of said one or more musical sequences.

5. The apparatus of claim 1 wherein said one or more conditional messages include one or more messages for transposing one or more instrument parts of said one or more musical sequences.

6. The apparatus of claim 1 wherein said one or more conditional messages include one or more messages for changing the volume of one or more instrument parts of said one or more musical sequences.

7. The apparatus of claim 1 wherein said one or more conditional messages include one or more messages for changing the instrument selection of one or more instrument parts of said one or more musical sequences.

8. The apparatus of claim 1 wherein said one or more conditional messages include one or more jump messages for directing said means for evaluating to a location within said decision tree.

9. The apparatus of claim 1 wherein said one or more conditional messages include one or more messages for looping one or more of said one or more musical sequences.

10. The apparatus of claim 1 wherein said means for evaluating include means for enabling or disabling one or more of said one or more conditional messages.

11. The apparatus of claim 10 wherein said one or more conditional messages include one or more hook messages, and wherein said means for enabling or disabling further comprise means for storing one or more identification values, each of said identification values corresponding to one or more of said hook messages.

12. The apparatus of claim 11 wherein said means for evaluating further include means for comparing each of said one or more hook messages with said one or more identification values to determine whether or not to perform each of said one or more hook messages.

13. The apparatus of claim 1 wherein said means for evaluating include means for storing one or more commands for delayed execution.

14. The apparatus of claim 13 wherein said one or more conditional messages include one or more marker messages, and wherein said means for storing one or more commands include means for storing one or more trigger values, each of said trigger values corresponding to one or more of said marker messages.

15. The apparatus of claim 14 wherein said means for evaluating further include means for comparing one or more of said marker messages with one or more of said trigger values, to determine whether or not to perform one or more of said stored commands.

16. The apparatus of claim 1 wherein said musical performance data and said conditional messages include one or more MIDI compatible messages.

17. A method for dynamically composing a musical sound track, said method comprising the following steps:

specifying a composition database, said composition database comprising musical performance data corresponding to one or more musical sequences;

integrating one or more conditional messages with said musical performance data in said composition database, forming a musical decision tree;

providing real-time input;

evaluating said musical decision tree, depending on said real-time input; and forming said musical sound track.

18. The method of claim 17 wherein said decision tree defines a plurality of alternative paths connecting one or more of said musical sequences, and said step of evaluating further includes the step of selecting one or more of said paths depending on said real-time input.

19. The method of claim 18 wherein said one or more musical sequences include one or more transitional sequences, each of said one or more transitional sequences for providing a musical transition from a source sequence to either a destination sequence or to a musical termination.

20. The method of claim 17 wherein said one or more conditional messages include one or more messages for turning on or off one or more instrument parts of said one or more musical sequences.

21. The method of claim 17 wherein said one or more conditional messages include one or more messages for transposing one or more instrument parts of said one or more musical sequences.

22. The method of claim 17 wherein said one or more conditional messages include one or more messages for changing the volume of one or more instrument parts of said one or more musical sequences.

23. The method of claim 17 wherein said one or more conditional messages include one or more messages for changing the instrument selection of one or more instrument parts of said one or more musical sequences.

24. The method of claim 17 wherein said one or more conditional messages include one or more jump messages, and said step of evaluating further includes the step of conditionally jumping to a location within said decision tree as directed by said one or more jump messages.

25. The method of claim 17 wherein said one or more conditional messages include one or more messages for looping one or more of said one or more musical sequences.

26. The method of claim 17 further including the step of enabling or disabling one or more of said one or more conditional messages in response to said real-time input.

27. The method of claim 26 wherein said one or more conditional messages include one or more hook messages, and said step of enabling or disabling includes the step of storing one or more identification values, each of said identification values corresponding to one or more of said hook messages.

28. The method of claim 27 further including the step of comparing each of said one or more hook messages with said one or more identification values to determine whether or not to perform each of said one or more hook messages.

29. The method of claim 17 further including the step of storing one or more commands for delayed execution, in response to said real-time input.

30. The method of claim 29 wherein said one or more conditional messages include one or more marker messages, and said step of storing one or more commands includes the step of storing one or more trigger values, each of said trigger values corresponding to one or more of said marker messages.

31. The method of claim 30 further including the step of comparing one or more of said marker messages with one or more of said trigger values, to determine whether or not to interpret one or more of said stored commands.

32. The method of claim 17 wherein said performance data and said conditional messages include one or more MIDI compatible messages.

* * * * *